US008003907B2

(12) United States Patent
Hoshino et al.

(10) Patent No.: US 8,003,907 B2
(45) Date of Patent: Aug. 23, 2011

(54) OPERATION DEVICE AND ELEVATOR APPARATUS WITH OPERATION DEVICE

(75) Inventors: Takeshi Hoshino, Kodaira (JP); Akiko Obata (nee Nakajima), Tokyo (JP); Atsushi Maki, Fuchu (JP); Yukari Yamamoto, Kunitachi (JP); Manabu Yanagimoto, Kawasaki (JP); Yujin Tsukada, Saitama (JP); Chizuko Sasanabe, Mitaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/607,209

(22) Filed: Oct. 28, 2009

(65) Prior Publication Data

US 2010/0243381 A1 Sep. 30, 2010

(30) Foreign Application Priority Data

Mar. 31, 2009 (JP) ..... 2009-083963
Jun. 3, 2009 (JP) ..... 2009-133624

(51) Int. Cl.
*H01H 13/83* (2006.01)

(52) U.S. Cl. ..... 200/314; 200/308; 200/310; 200/313

(58) Field of Classification Search ..... 200/308–317, 200/330, 331, 518, 42.01
See application file for complete search history.

(56) References Cited

U.S. PATENT DOCUMENTS

| | | | | | |
|---|---|---|---|---|---|
| 3,827,039 | A * | 7/1974 | Agnese | 340/586 |
| 4,743,724 | A * | 5/1988 | Goodwin et al. | 200/331 |
| 4,901,238 | A | 2/1990 | Suzuki et al. | |
| 5,055,645 | A * | 10/1991 | Hull et al. | 200/331 |
| 5,819,913 | A * | 10/1998 | Reiter | 200/332 |
| 6,227,335 | B1 * | 5/2001 | Koeppe et al. | 187/414 |
| 6,230,847 | B1 * | 5/2001 | Skolnick | 187/395 |
| 6,237,138 | B1 * | 5/2001 | Hameluck et al. | 717/128 |
| 6,550,586 | B1 * | 4/2003 | Takeuchi | 187/391 |
| 2006/0054421 | A1 * | 3/2006 | Ikeda | 187/395 |
| 2006/0232987 | A1 | 10/2006 | Kushida et al. | |

FOREIGN PATENT DOCUMENTS

| | | | |
|---|---|---|---|
| JP | 57-115232 | A | 7/1982 |
| JP | 63-275323 | A | 11/1988 |
| JP | 8-73145 | A | 3/1996 |
| JP | 9-98972 | A | 4/1997 |
| JP | 2006-298045 | A | 11/2006 |
| JP | 2007208863 | A * | 8/2007 |

* cited by examiner

*Primary Examiner* — Michael A Friedhofer
(74) *Attorney, Agent, or Firm* — Mattingly & Malur, PC

(57) ABSTRACT

To reduce the number of erroneous operations, on an operation apparatus conducting mutually different operations such as opening and closing operations, a concretized human pictogram indicating mutually different state changes such as state changes represented by use of a face with opened eyes and a face with closed eyes associated with operation signals assigned to a pair of operation switches and a pictogram in which the human pictogram is combined with an operation pictogram representing a state in which a door concretizing an operation target to operate in response to an operation signal is opened or is being completely closed are respectively attached to the operation switches disposed adjacent to each other.

11 Claims, 25 Drawing Sheets

(a)

(b)

(c)

OPERATION DEVICE AND ELEVATOR APPARATUS WITH OPERATION DEVICE

INCORPORATION BY REFERENCE

The present application claims priorities from Japanese applications JP 2009-083963 filed on Mar. 31, 2009, JP 2009-133624 filed on Jun. 3, 2009, the contents of which are hereby incorporated by reference into this application.

BACKGROUND OF THE INVENTION

The present invention relates to a method of marking an operation device with pictograms to be attached to the operation device which conducts mutually different operations of, for example, ON/OFF or Open/close and an operation device marked with such pictograms.

In general, an operation switch is provided with an identification letter and/or a pictorial symbol, i.e., pictogram for the user to recognize a function of the operation switch. To reduce erroneous operations, pictograms desirably have high visibility and identifiability.

Particularly, for a switch such as the ON/OFF or Open/close switch which causes either one of the mutually different operations depending on the user's operation, it is desired to reduce erroneous operations. For this purpose, it is required to make the user first detect a target switch, for example, the ON/OFF or Open/close switch and then identify which one of the constituent components of the switch is ON or OFF.

For example, almost everyone has an experience of erroneous operations in an elevator. That is, to hastily open the closing door of the elevator for a person who desires to take the elevator, a passenger in the elevator cage mistakenly operates the Open/close switch disposed in an operation panel to resultantly close the door. This takes place because although the passenger empirically knows the locations of the Open and Close switches, it is not possible for the passenger to hastily judge which one of the switches is the Open switch to be selected to open the door.

To remove this problem, it is effective to mark characters such as "開" ("Open" in Japanese), "閉" ("Close" in Japanese), "OPEN", and "CLOSE" on the surface of the Open/close switch as shown in (a) and (b) of FIG. 28. In the globalized environment today, these characters or letters are available only for those who can read such characters or letters. Hence, in general, pictograms are primarily employed, for example, as (c) of FIG. 28 in which a central straight line and a pair of arrows respectively indicating the closing and opening directions are used to represent the closed and open states of the door. Also, to solve the problem, it has been proposed to form the Open switch and the Close switch in concave and convex shapes, respectively.

As above, the marking characters or letters of the Open/close switch are arranged on an operation panel or a console for the user to detect the Open/close switch. After the detection thereof, it is desired that the letters call the user's attention with identifiability thereof. According to recent brain studies, there exist neurons which are highly reactive upon being stimulated by particular patterns. For monkeys, a hand neuron highly sensitive to a hand pattern and a face neuron highly sensitive to a face pattern have been reported. According to an article, this effect is also the case with humans.

As confirmation of the effect, reference has been made to good results attained in examples in which a road sign and a pedestrian sign to which a notice and a human image are attached are employed in a pedestrian crossing as well as in an example in which a board on which a human hand and a notice are presented is installed at a place of illegal dumping.

For a headlight of a motorcycle, it has also been proposed to produce the headlight in a form like a human eye. This easily reminds one of a human face. Hence, when a driver of a car running before a motorcycle catches, by use of a rear view mirror, an image of the motorcycle with such headlight, the effect of the headlight calls attention of the driver to existence of the motorcycle.

These techniques are described in JP-A-8-73145, JP-A-2006-298045, JP-A-57-115232, JP-A-63-275323, and JP-A-9-98972.

SUMMARY OF THE INVENTION

In use of the Open/close switch of an elevator, it has been experimentally verified that the user conducts an erroneous operation more frequently for the switch marked with a pictogram which is generally employed today and which is shown in (c) of FIG. 28 than for the switch marked with "開" and "閉" shown in (a) of FIG. 28. The reason will be as follows. In use of an operation switch, the user views the switch and recognizes that the switch is the Open/close switch of the door. Based on experiences in the past, the user identifies that the switch with "開" is an operation switch to open the door, and then the user conducts a desired operation. Hence, to identify a pictogram, the reaction speed of the user is lowered for a pictogram if the user has little experience for the pictogram in the past. That is, since the user knows the character "開" since his or her childhood, it is possible for the user to instantaneously recognize an operation switch with "開" as the Open/close switch based on empirical knowledge. The reason why the pictograms shown in (c) of FIG. 28 cause more erroneous operations as compared with the Open/close character switch is as follows. The user has little experience in recognizing that these pictograms are used to open and to close the door. Moreover, since the pictograms are schematically simplified images, a long period of time is required for the user to recognize the meanings of the pictograms. Naturally, an "Open" switch is familiar only to a person who uses English as his or her mother tongue. Hence, for any user whose mother tongue is other than English, a long period of time is required to identify and to recognize the meaning of the switch. Hence, when the user must hastily operate the switch, he or she makes relatively oftener an erroneous operation.

It is therefore an object of the present invention to provide a method of marking pictograms, for reducing erroneous operations, on an operation device to conduct mutually different operations such as ON/OFF or Open/close and to an operation device marked with the pictograms.

To achieve the object according to the present invention, there are provided a method of marking pictograms and an operation device marked with the pictograms wherein a concretized human pictogram is marked on a pair of operation switches disposed adjacent to each other, the pictograms indicating mutually different state changes associated with operation signals assigned to the operation switches.

Additionally, to achieve the object according to the present invention, there are provided a method of marking pictograms and an operation device marked with the pictograms wherein a pictogram including a combination of a concretized human pictogram and a concretized operation pictogram are marked on a pair of operation switches disposed adjacent to each other, the human pictograms indicating mutually different state changes associated with operation signals assigned to the operation switches, the operation pictogram concretizing an operation target which operates in response to an operation signal.

According to the present invention, the human pictogram calls the user's attention to the operation switch, thereby increasing recognizability thereof. In association with a state change expressed by the human pictogram, the operation of an operation target corresponding to the state change is recollected. This improves identifiability and it is possible to appropriately guide the user to conduct an associated operation. As a result, the time necessary for judgment becomes shorter and the number of erroneous operations are reduced.

According to the present invention, the human pictogram calls the user's attention to the operation switch to improve recognizability thereof. In association with a state change expressed by the human pictogram, the operation of an operation target corresponding to the state change is recollected. Based on association established between the recollection and the operation pictogram, it is possible to improve identifiability. Hence, the judging process is carried out in a shorter period of time and the number of erroneous operations are minimized.

Other objects, features and advantages of the invention will become apparent from the following description of the embodiments of the invention taken in conjunction with the accompanying drawings.

DESCRIPTION OF THE EMBODIMENTS

Figure 1:
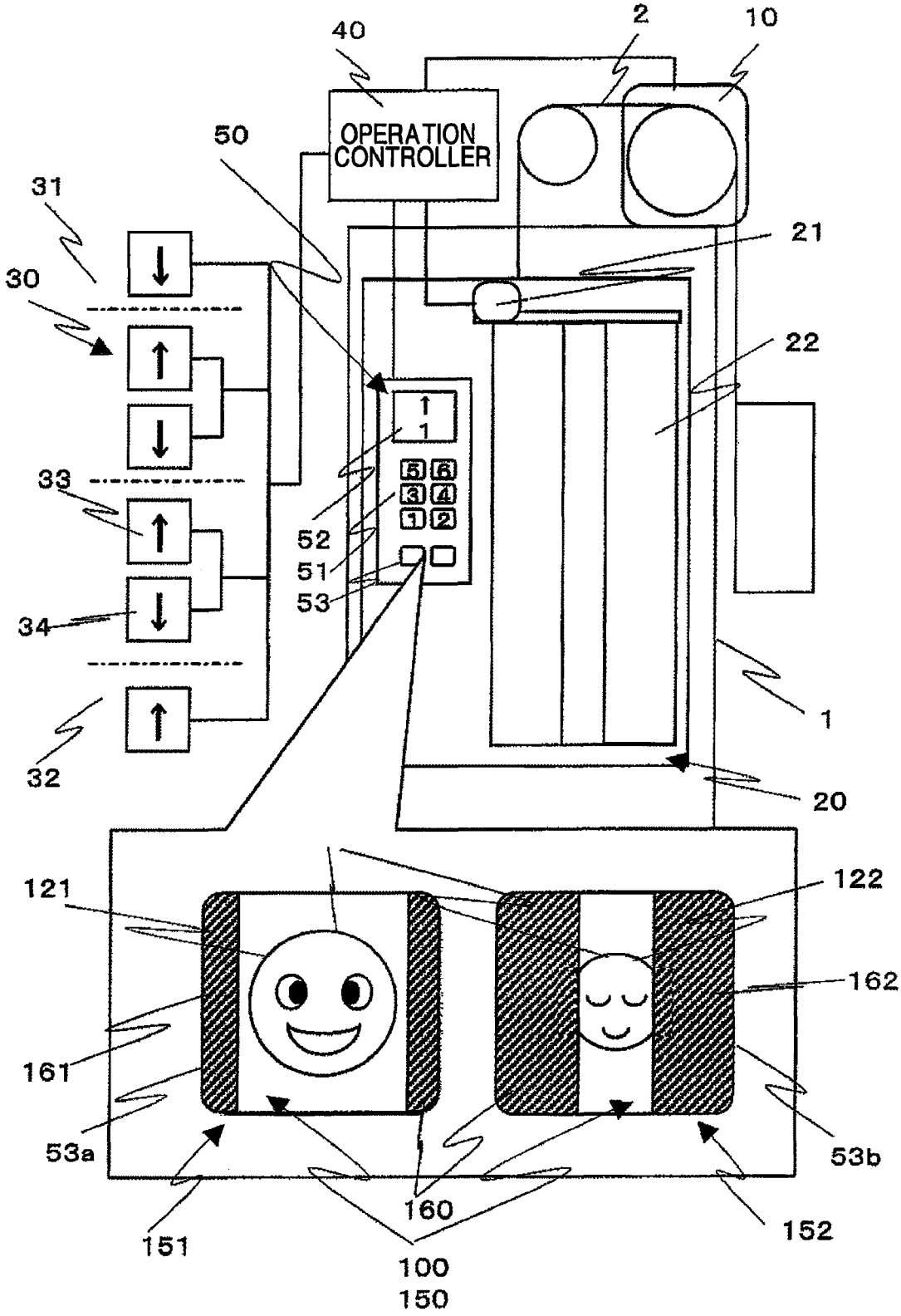
FIG. 1 is a block diagram schematically showing a structure of an elevator apparatus according to a first embodiment.

Referring now to the accompanying drawings, description will be given in detail of a method of marking pictograms and an operation device marked with the pictograms. The same constituent components, the same arrows, and the like will be assigned with the same reference numerals, and duplicated description thereof will be avoided.

First Embodiment

Referring to FIG. 1, FIGS. 2A and 2B, FIGS. 3 to 17, FIGS. 18A to 18C, FIGS. 19A and 19B, FIGS. 20A and 20B, FIGS. 21A and 21B, FIGS. 22A and 22B, and FIG. 23 description will be specifically given of pictograms 100 employed for an operation panel of an elevator apparatus according to the first embodiment. However, the elevator apparatus is only an example of the embodiment and does not restrict the present invention. That is, the pictograms 100 are applicable to a pair of operation buttons to which operation signals of mutually different operation targets are assigned.

Referring first to FIG. 1, description will be given of an outline of a structure of the elevator apparatus according to the first embodiment. FIG. 1 shows the outline of a structure of the elevator apparatus.

In FIG. 1, the elevator apparatus includes an elevator passageway 1 disposed as a shaft or a well in a building, a driver 10 arranged in an upper section of the elevator passageway 1, an elevator cage 20 installed to go upward and downward in the elevator passageway 1, elevator buttons 30 arranged in each elevator hall of the building, and an operation controller 40 to control operation to drive the elevator apparatus.

The driver 10 conducts a driving operation to move the cage upward or downward, for example, by winding up a rope 2 one end of which is attached to the cage 20. The cage 20 includes an operation panel 50 to indicate an operation from a position in the cage 20 to the elevator apparatus and a door driver 21 to open and to close a door 22 disposed in the cage 20. The operation panel 50 includes a plurality of destination buttons 51, a destination display 52, and an Open/close button 53 indicating an operation to close or to open the door 22. An up/down button 30 includes a pair of buttons, i.e. 33 and 34, an up button and a down button in the elevator halls excepting the elevator halls at an upper-most floor 31 and a lower-most floor 32. The operation panel 50 may be, for example, a liquid-crystal touch panel not employing buttons. Also, a part of the operation panel 50 may be a liquid-crystal touch panel.

In operation of the elevator apparatus of the embodiment, when an indication of operation is received from the elevator buttons 30, the operation controller 40 performs operation control. Specifically, the controller 40 urges the driver 10 to move the cage 20 to the floor of the elevator hall where the elevator buttons 30 are installed. The controller 40 then controls the door driver 21 to open the door 22. When the destination button 51 and the Open/close button 53 are operated on the operation panel 50, the controller 40 receives an indication of the operation. The controller 40 then closes the door 22 and moves the cage 20 to a target elevator hall indicated by the destination button 51.

One aspect of the first embodiment of the elevator apparatus resides in that a concretized human pictogram 110 is arranged on a surface of the Open/close button 53 including a pair of buttons, i.e., an Open button 53*a* and a Close button 53*b* disposed adjacent to each other. The human pictogram 110 indicates changes in its state respectively related to "open" and "close" respectively assigned to the buttons 53*a* and 53*b*. According to the aspect, the human pictogram 110 calls the user's attention to the Open/close button 53. In association with the state change represented by the human pictogram 110, the operation of an operation target corresponding to the state change is recollected to thereby improve the identifiability. It is hence possible to appropriately guide the user to conduct the operation. As a result, the judging time becomes shorter and the chance of erroneous operations decreases. This advantageously removes the conventional problem in which to hastily open the closing door of the elevator for a person who desires to take the elevator, a passenger in the elevator cage mistakenly operates the Open/close button 53 to resultantly close the door.

According to brain study today, there exist brain regions particularly sensitive to, for example, a human hand and a human face. This will be supported and confirmed by good results of conventional examples wherein a road sign and a pedestrian sign on which a human image and a notice are presented are installed on the roadside as well as a board on which a human hand and a notice are presented is installed at a place of illegal dumping. It can be hence assumed that the human image marked on the Open/close button 53 urges the user to pay attention to the Open/close button 53.

However, in operation of the Open/close button 53 which indicates mutually different operations by use of the Open button 53*a* and the Close button 53*b*, the above problem cannot be solved only by recalling user's attention. That is, in use of the Open/close button 53, the user views the button 53 to recognize that the button 53 is the Open/close button 53 to open and to close the door. Based on experiences in the past, the user identifies that the Open button 53*a* with "開" is disposed to open the door, and then the user conducts the operation to open the door. Therefore, the problem of the prior art cannot be removed only by recognizing the Open/close button 53.

To remove the problem, by paying attention to the fact that the Open/close button 53 serves a function to indicate mutually different operations, the inventors thought of a novel idea. That is, the mutually different state changes corresponding to "open" and "close" operations respectively assigned to the constituent buttons of the Open/close button 53 are concretized and are expressed by use of a "human pictogram 110". For example, a "standing image" and a "walking image" of a human or a "face with open eyes" and a "face with closed eyes" are presented in a pair.

In the embodiment, a face pictogram 120 representing a human face is adopted for the Open/close button 53 including a pair of buttons which have mutually different functions and which are disposed adjacent to each other. The mutually different state changes are represented as a "face with open eyes" and a "face with closed eyes". That is, the "open-eye face pictogram" 121 of the face with open eyes is assigned to the Open button 53*a* and the "closed-eye face pictogram" 121 of the face with closed eyes is assigned to the Close button 53*b* in the configuration. The face pictogram 120 can urge the user to directly recollect the opening and closing operations of the door 22.

The human pictogram 110 is concretized to a degree so that the concretized image is identified as a human. For example, an overall image of a human is represented by, for example, a silhouette which implies a human operation or posture. Also, a human face is represented in a concretized image to be identified as a face of a human. Particularly, for the human face image, it is quite important to appropriately present the eyes for the following reason. If a human and a changed state of the human are too realistically expressed, the user observes the realistic contents of the expressed image. It is hence not possible to fulfill the inherent purpose in which the image calls the user's attention to urge the user to instantaneously recall an associated operation at the state change of the image.

Another aspect of the elevator apparatus according to the first embodiment resides in that a combination pictogram 150 in which the human pictogram 110 indicating the state changes is combined with an "operation pictogram 160" concretizing an operation target to be operated by an operation signal of the Open/close button 53 is marked on the constituent buttons of the Open/close button 53. According to the aspect, the human pictogram 110 calls the user's attention to the Open/close button 53 to increase recognizability thereof. This improves identifiability of the operation pictogram 160 concretizing a state change expressed by the human pictogram 110. Hence, the operation can be appropriately guided to reduce the judging time and the chance of erroneous operations. That is, by combining the operation pictogram 160 with the human pictogram 110, identifiability of the operation of the operation target corresponding to the state change of the human pictogram 110 is further recollected for the operation guidance. Hence, it is possible to reduce the judging time and the chance of erroneous operations.

In the embodiment, as the operation pictogram 160, there are prepared, in a pair, an opening pictogram 161 recalling a state of a pair of sliding doors 22 which are being outwardly retracted to the respective sides and a closing pictogram 162 recalling a state of the sliding doors 22 which are being almost closed. By combining the opening pictogram 161 with the open-eye face pictogram 121, an open combination pictogram 151 serving as the Open button 53*a* is created. By combining the closing pictogram 162 with the closed-eye face pictogram 122, a close combination pictogram 152 serving as the Close button 53*b* is created. By marking the open combination pictogram 151 and the close combination pictogram 152 respectively on the constituent buttons of the Open/close button 53, the state change of the face pictogram 120 bridges the gap between the face pictogram 120 to attract attention of the user and the operation pictogram 160 to directly recall the operation target to be operated. The user can hence instantaneously recognize and identify the objective button. Thanks to this operation guidance, the judging time and the chance of incorrect operations are reduced.

Figure 2A:
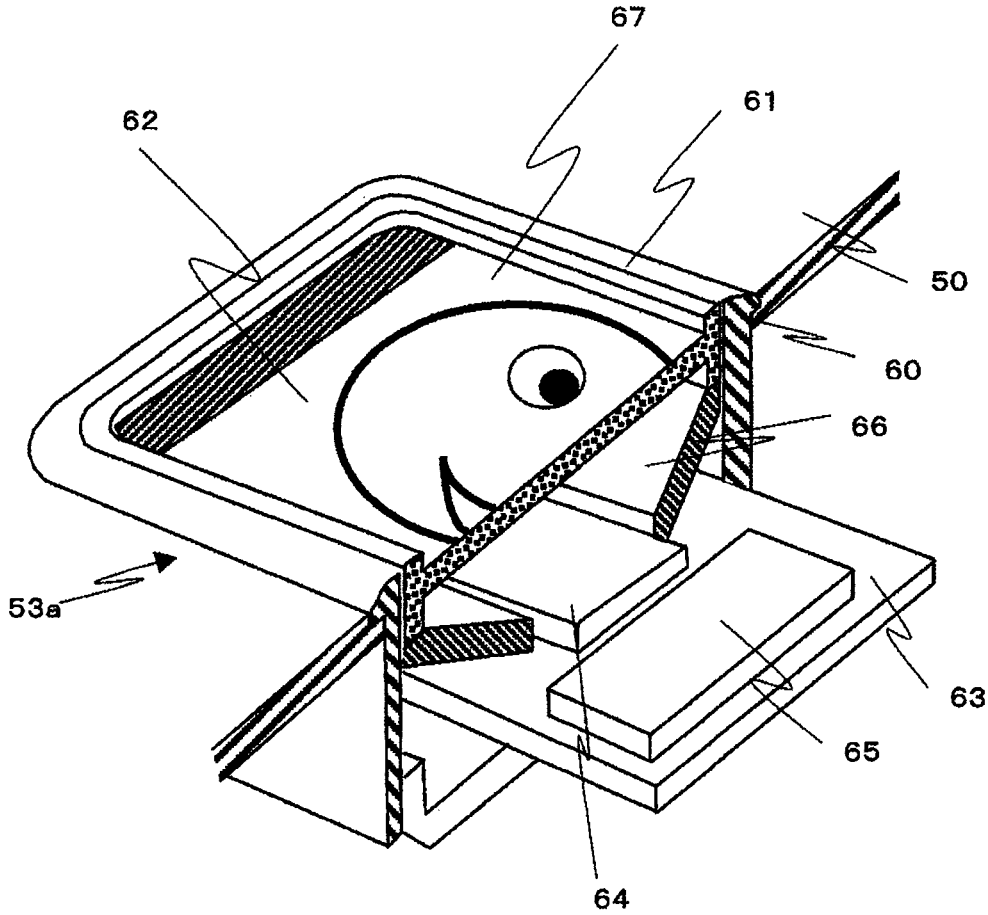
FIG. 2A is a perspective view showing a configuration of one of Open/close buttons of the embodiment.
Figure 2B:
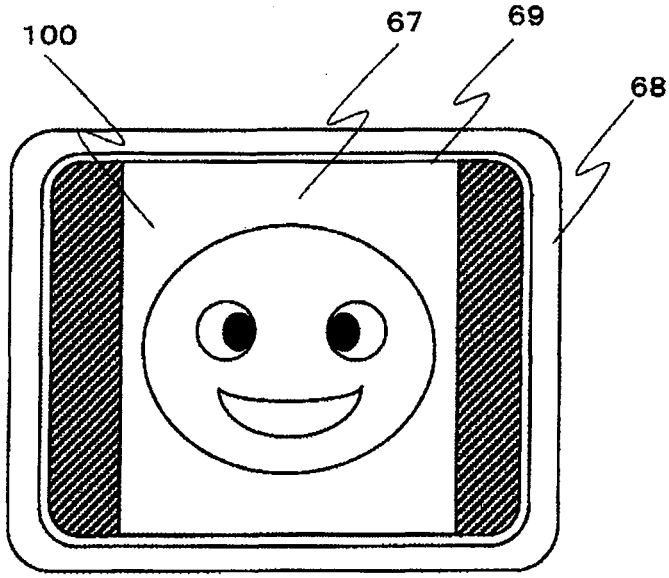
FIG. 2B is a perspective view showing a configuration of one of Open/close buttons of the embodiment.

Referring next to FIGS. 2A and 2B to FIG. 23 description will be made in more detail of pictograms according to the embodiment. FIGS. 2A and 2B show a structure of the Open/close button. FIGS. 3 to 12 show appearances of pushing sections marked with pictograms according to the embodiment. FIGS. 13 to 17, FIGS. 18A to 18C, FIGS. 19A and 19B, FIGS. 20A and 20B, FIGS. 21A and 21B, FIGS. 22A and 22B, and FIG. 23 show results of experiments conducted for pictograms according to the embodiment. Description will be given of FIGS. 3 to 12 by referring to the experimental results according to necessity.

First, description will be given in detail of specific structure of the Open/close button 53 with the pictogram 100 according to the embodiment. FIG. 2A is a perspective view showing part of a cross section of the Open button. FIG. 2B shows an upper surface of the Open button. The Close button and the other destination buttons are similarly constructed.

In FIG. 2A, the Open button 53*a* includes a button case 61 which is engaged with and is attached to an opening 60 disposed in the operation panel 50, a pushing section 62 attached in the button case 61 to be set to an up position and to a down position, a switch plate 63 arranged below the pushing section 62, a light emitting section 64 disposed on the switch plate 63 beneath the pushing section 62, a switching element 65 arranged on the switch plate 63 in the periphery of the light emitting section 64, a reflection plate 66 disposed to transfer stress received by the pushing section 62 to the switching element 65 and to reflect light from the light emitting section 64 to the side of the opening 60, and a spring, not shown, to keep a predetermined distance between the pushing section 62 and the switch plate 63. FIGS. 2A and 2B show only an example of the structure of the Open/close button. The present invention is not restricted by the structure.

The pushing section 62 includes thereon a substantially flat, letter display surface 67 and is arranged such that the letter display surface 67 and the operation panel 50 are in substantially the same plane in an ordinary state. When the user pushes the letter display surface 67 into the button case 61 by, for example, a finger, it is possible that the pushing section 62 including the letter display surface 67 changes, via the reflection plate 66, the switch element 65 from an off state to an on state. In the on state, the light emitting section 64 is turned on, i.e., is set to an on state.

The letter display surface 67 is formed using a resin material having transparency such as an acrylic material. The pictogram 100 is attached onto the letter display surface 67 by use of materials having mutually different transmittivity, by coating, through a surface process, or by using sheets. Hence, when the light emitting section 64 turns on in the on state, the pictogram 100 appears on the letter display surface 67 due to light therefrom. This leads to easy and clear identification of the on state.

In the first embodiment, the button case 61 includes a flange outwardly extending in the periphery thereof. By inserting the button case 61 in the opening 60 such that the flange 68 comes into contact with the surface of the operation panel 50, the Open/close button is installed at a predetermined position of the operation plate 50. Hence, the frame-shaped flange 68 configuring the periphery of the pushing section 62 slightly projects from the surface of the operation panel 50. In this structure, the user can recognize the pushing section 62 only by touching the flange 68 by a finger.

Also, the pushing section 62 includes a depressed surface excepting a peripheral, narrow border section 69. The pictogram 100 is disposed onto the depressed letter display surface 67. This prevents useless contact between the user and the letter display surface 67. Hence, abrasion of the pictogram 100 is minimized. In the embodiment, by using the depression and the projection existing between the border section 69 and the flange 68 and the letter display surface 67, it is possible to form the pictogram 100 in a three-dimensional contour. This improves recognizability and identifiability of the Open/close button 53 in the Open/close button 53 by a finger.

Figure 3:
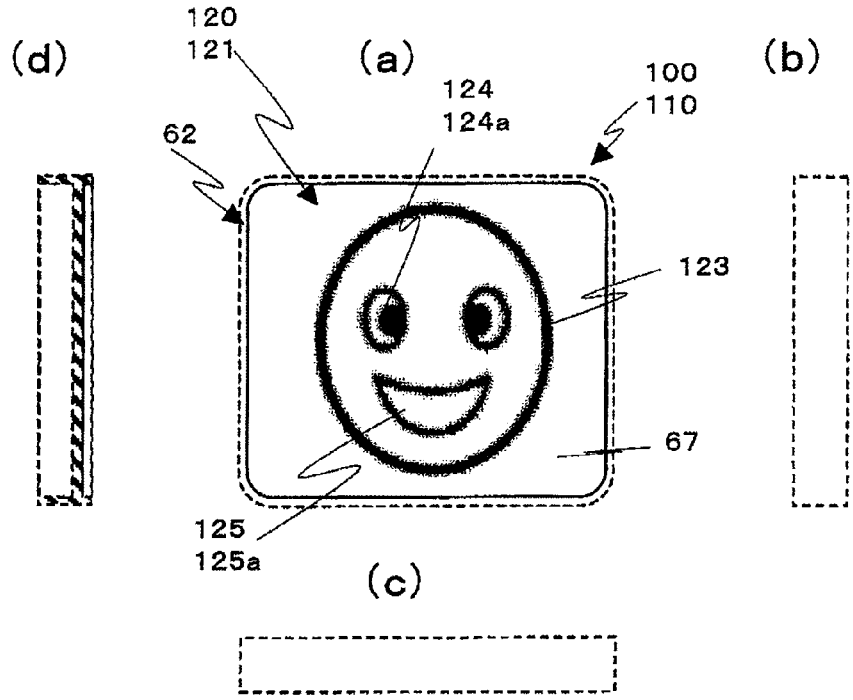
FIG. 3 is a perspective view showing a pushing section marked with a pictogram according to the embodiment.
Figure 4:
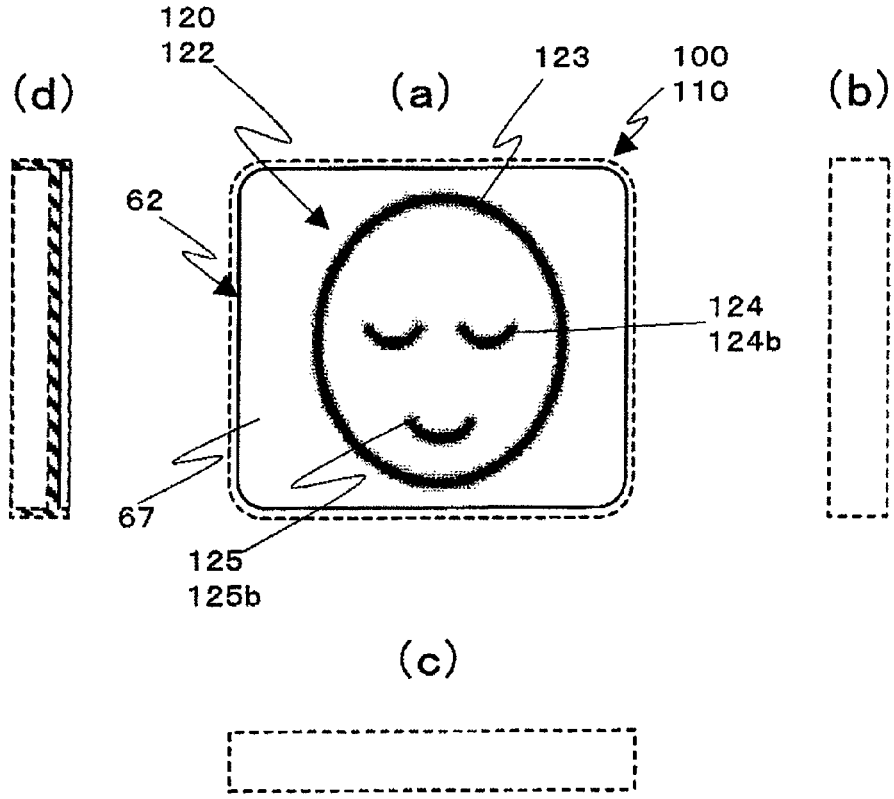
FIG. 4 is a perspective view showing a pushing section with a pictogram according to the embodiment.
Figure 5:
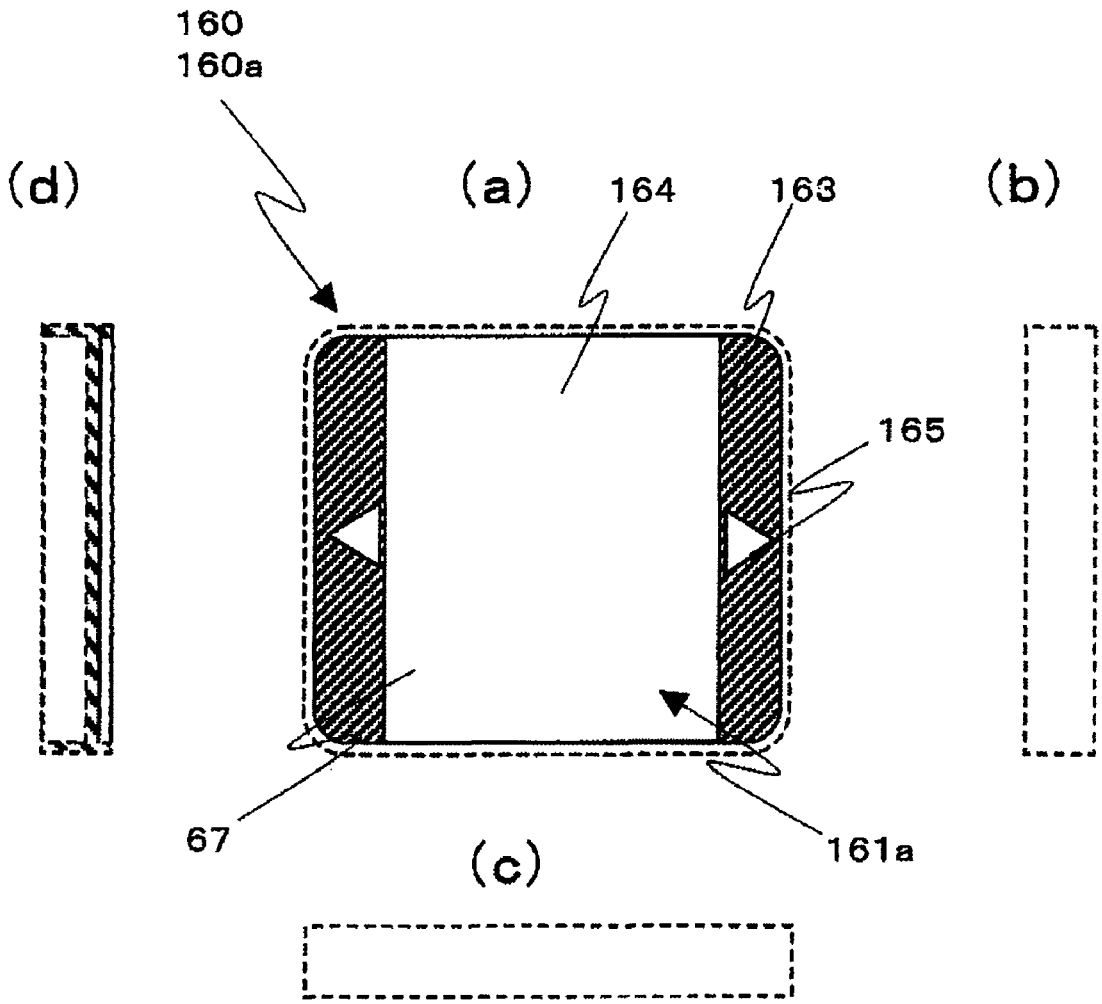
FIG. 5 is a perspective view showing a pushing section with a pictogram according to the embodiment.
Figure 6:
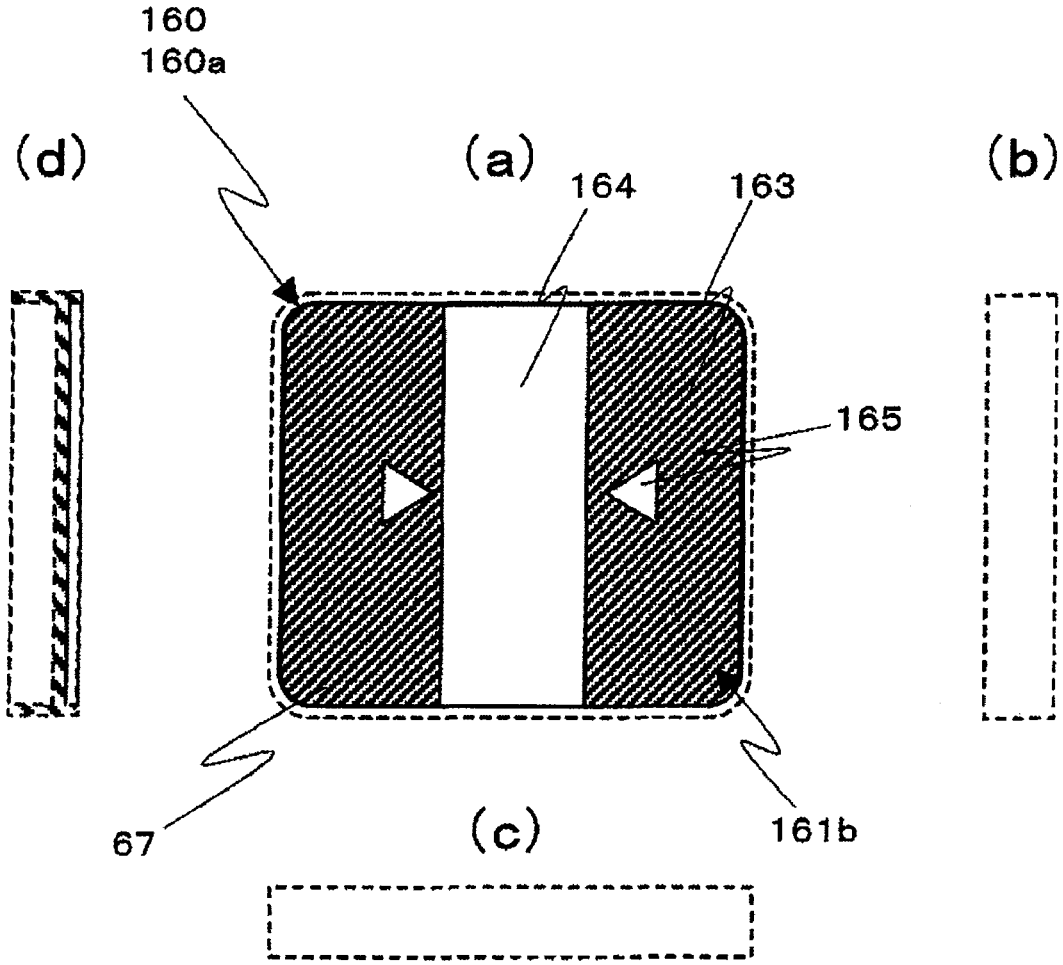
FIG. 6 is a perspective view showing a pushing section with a pictogram according to the embodiment.
Figure 7:
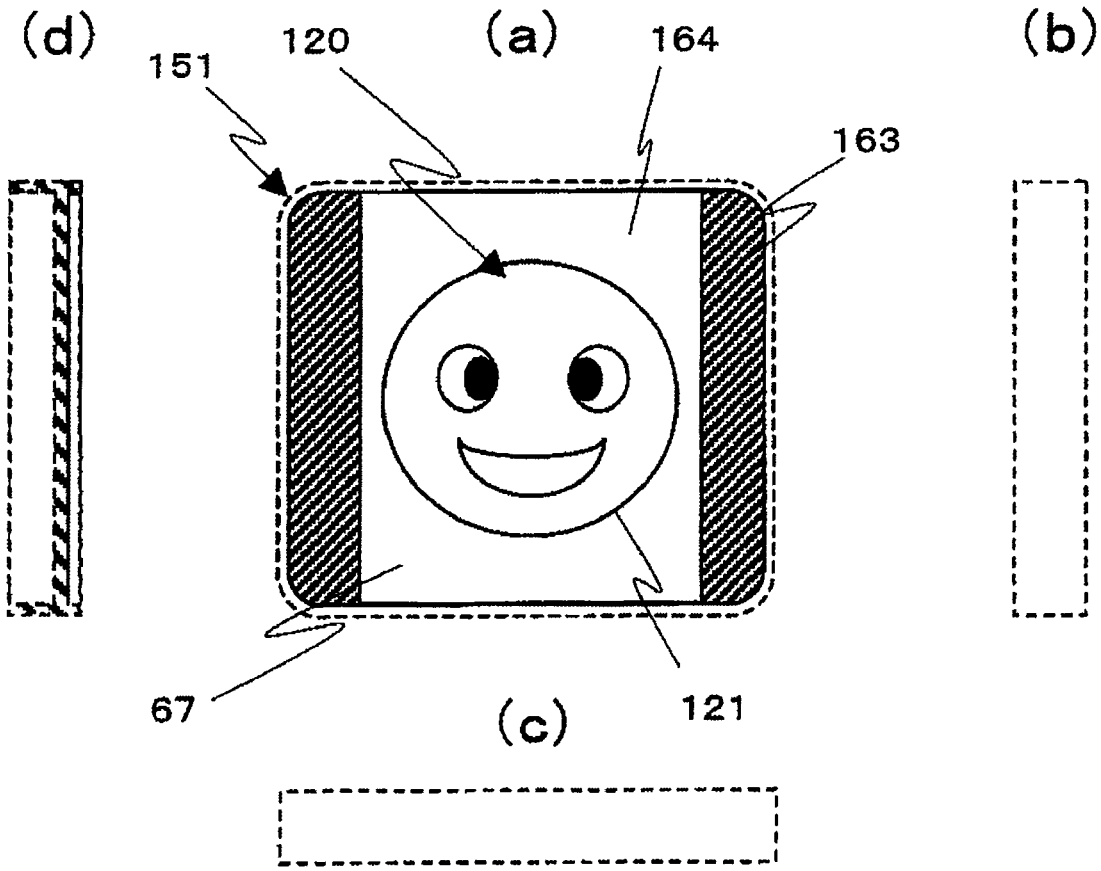
FIG. 7 is a perspective view showing a pushing section with a pictogram according to the embodiment.
Figure 8:
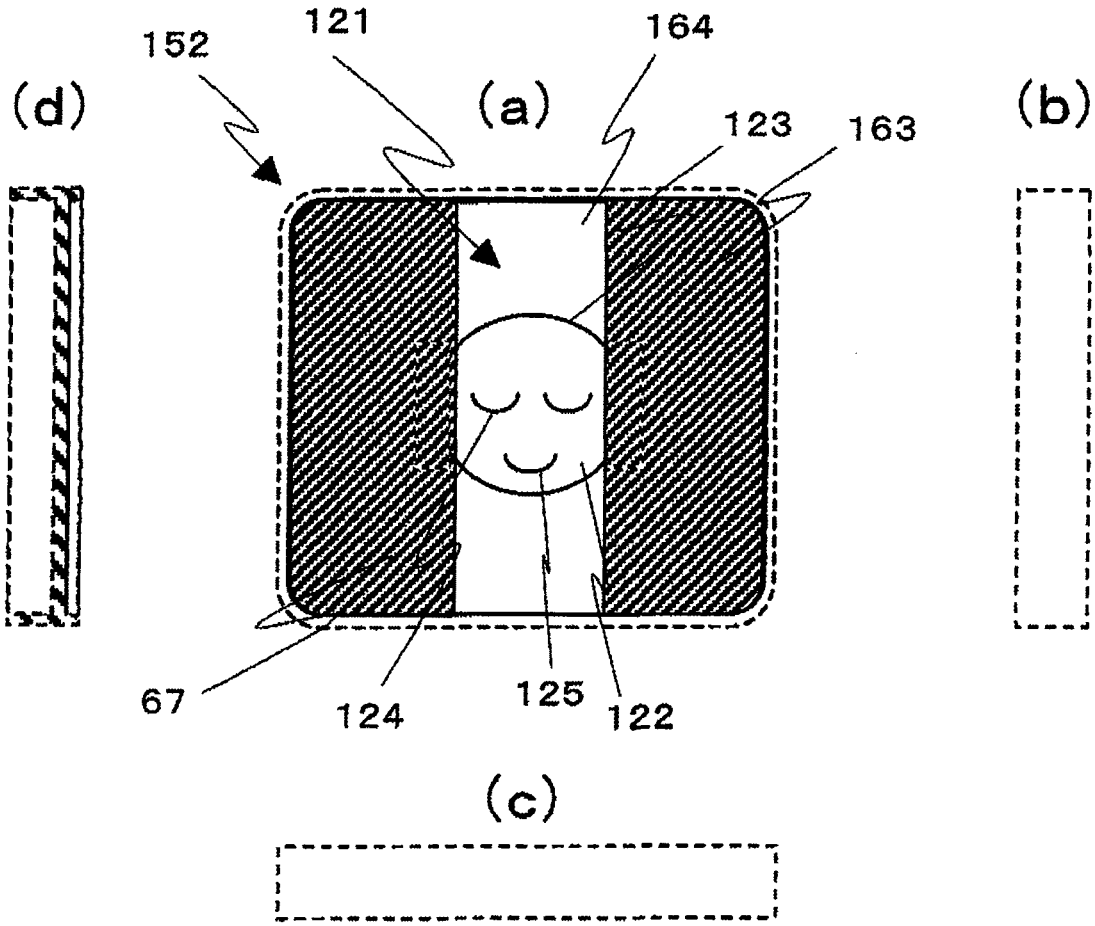
FIG. 8 is a perspective view showing a pushing section with a pictogram according to the embodiment.
Figure 9:
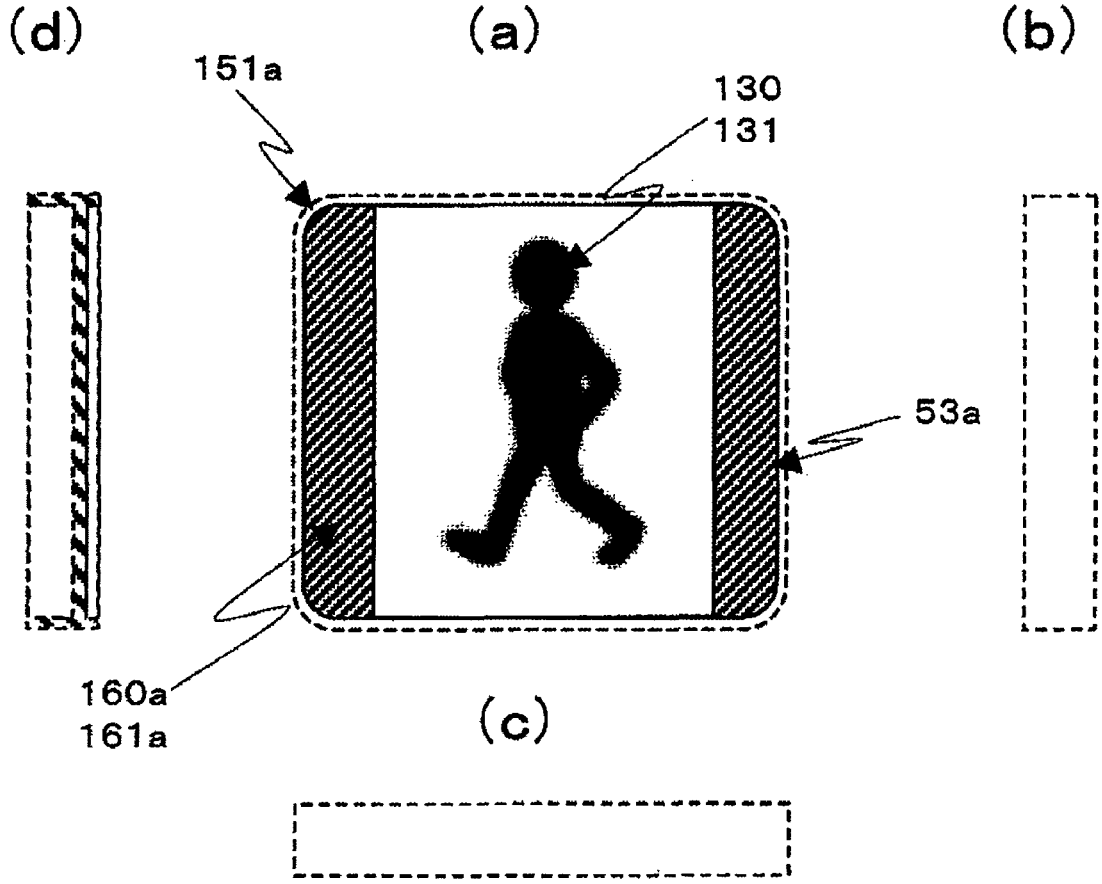
FIG. 9 is a perspective view showing a pushing section with a pictogram according to the embodiment.
Figure 10:
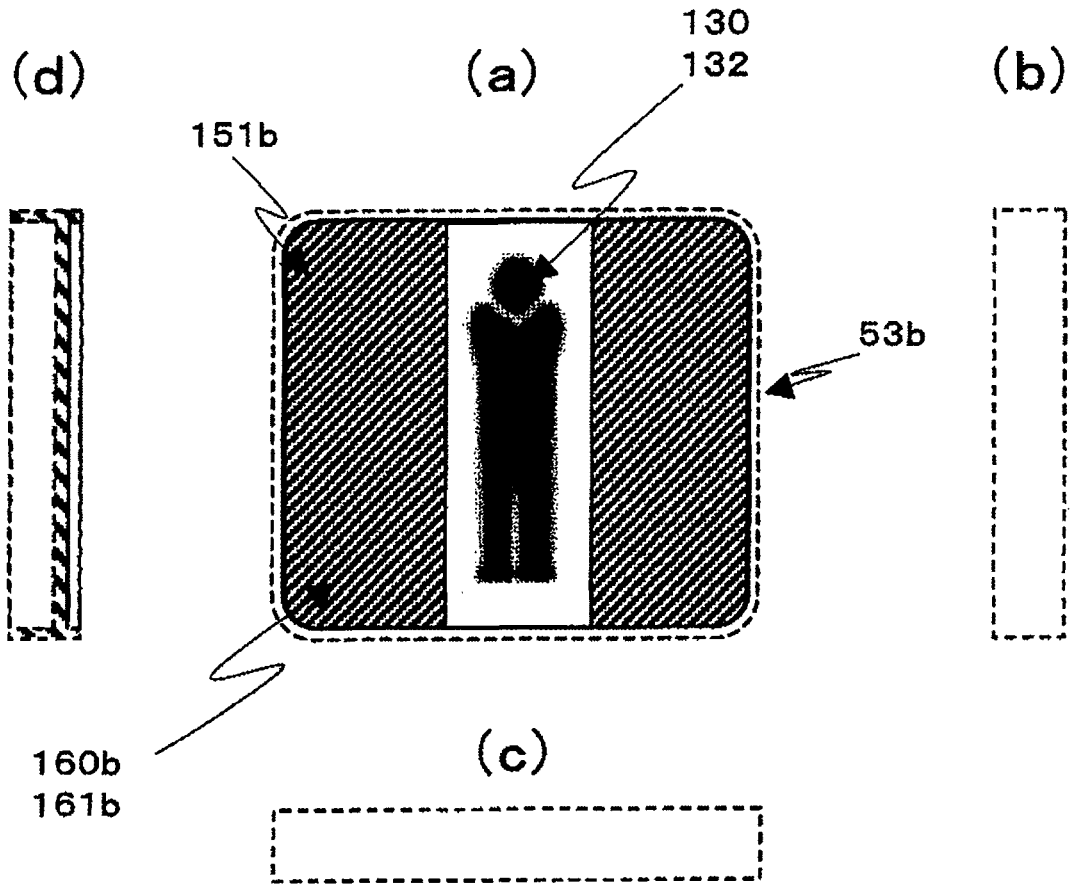
FIG. 10 is a perspective view showing a pushing section with a pictogram according to the first embodiment.
Figure 11:
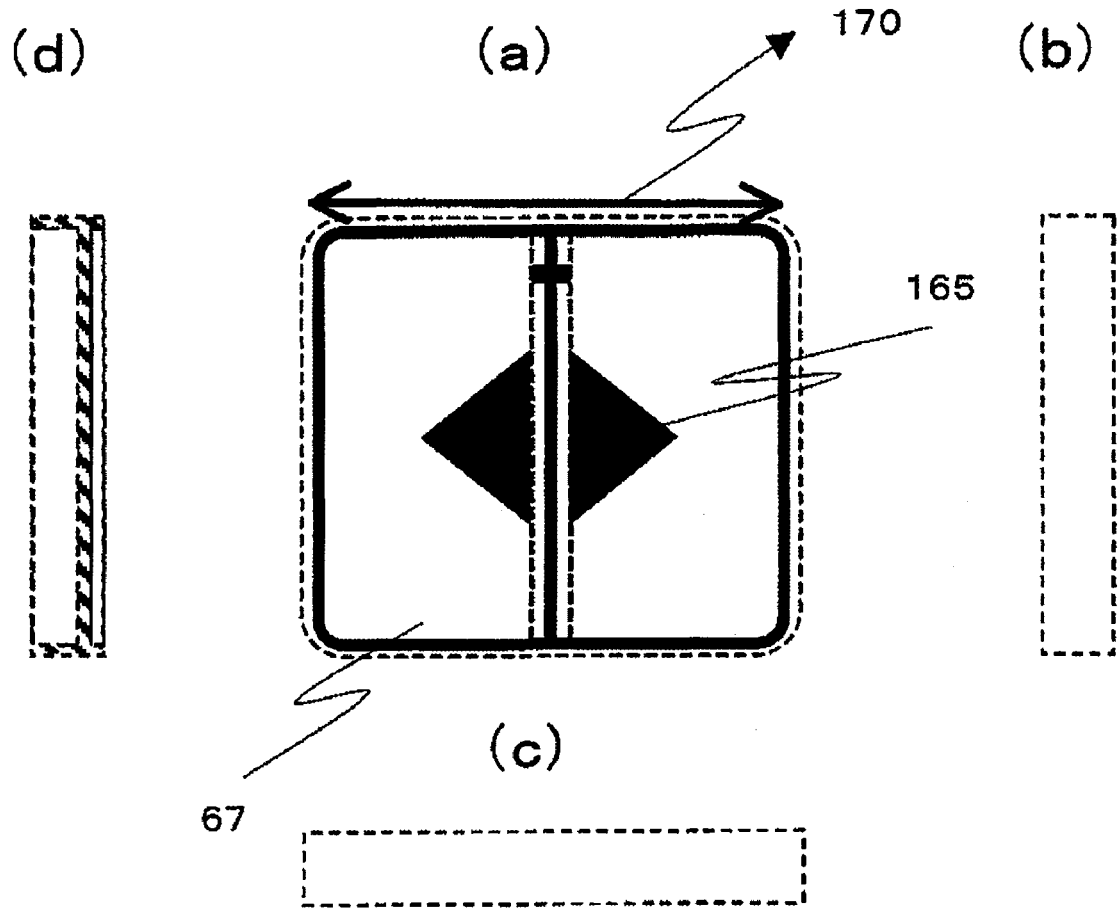
FIG. 11 is a perspective view showing a pushing section with a pictogram according to the embodiment.
Figure 12:
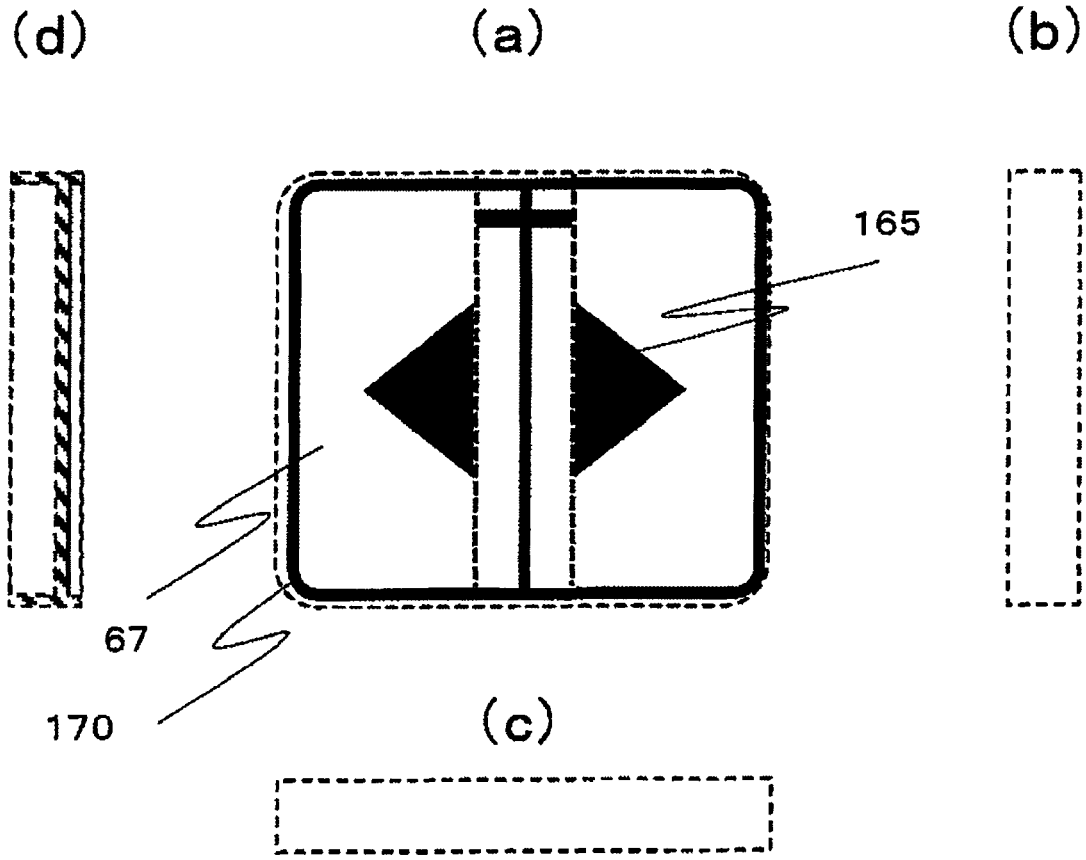
FIG. 12 is a perspective view showing a pushing section with a pictogram according to the embodiment.

Referring next to FIGS. 3 to 12, description will be concretely given of the pushing section 62 marked with a pictogram 100 applicable according to the first embodiment. FIG. 3 shows an appearance of an operation button marked with an open-eye face pictogram. FIG. 4 shows an appearance of an operation button to which a closed-eye face pictogram is attached. FIG. 5 is an appearance of an operation button marked with an open pictogram. FIG. 6 shows an appearance of an operation button to which a close pictogram is attached. FIG. 7 is an appearance of an operation button marked with an open combination pictogram including a face pictogram. FIG. 8 shows an appearance of an operation button to which a close combination pictogram including a face pictogram is attached. FIG. 9 is an appearance of an operation button marked with an open combination pictogram expressing an overall human image. FIG. 10 is an appearance of an operation button to which a close combination pictogram expressing an overall human image is attached. FIG. 11 is an appearance of an operation button marked with an open door pictogram expressing direction marks. FIG. 12 is an appearance of an operation button to which a close door pictogram expressing direction marks is attached.

In each of FIGS. 3 to 12 showing an appearance of a pushing section serving as an upper-most component of an operation button, (a) is a front view, (b) is a right-side view, (c) is a bottom view, and (d) is a central cross-sectional view. The property of symmetry exists between the left-side view and the right-side view of (b) and between the top view and the bottom view (c). Hence, the left-side view and the top view are not shown. The rear view is almost equal in appearance with the front view of (a) excepting that the letter display surface 67 is not provided with any pattern.

Also, in FIGS. 3 to 12 showing appearances of the embodiment, the letter display surface 67 as an important section (partial design) is indicated using a bold line, and the other sections are drawn by use of broken lines. Naturally, the overall appearance (overall design) of the pushing section in which bold lines are used in place of the broken lines is also a novel design. For easy understanding, description will be separately given of the important section and the other sections.

FIGS. 3 and 4 show top views of the pushing sections respectively of the open-eye face pictogram 121 and the closed-eye face pictogram 122 to which the face pictogram is applied. FIG. 3 shows an appearance of the pushing section with the open-eye face pictogram 121. FIG. 4 shows an appearance of the pushing section with the closed-eye face pictogram 121.

Referring to FIGS. 3 and 4, the face pictogram 120 is adopted as the human pictogram 110 in the embodiment. The face pictogram 120 includes a face contour 123, a pair of eyes 124, and a mouth 125. The state change to be expressed by the human pictogram 110 is indicated by whether or not the eyes 124 and the mouth 125 are opened.

In the open-eye face pictogram 121 shown in FIG. 3, the open eyes with pupils 124*a* and a mouth with opened lips 125*a* are expressed. In the closed-eye face pictogram 122 shown in FIG. 4, eyes with closed eyelids 124*b* and a mouth with closed lips 125*b* are expressed. The face pictogram 120 of the embodiment does not realistically express the human face, but conceptually expresses the human face in a simplified image.

For example, the face contour 123 is expressed by a simple circle or ellipse. In the open eyes with pupils 124*a*, black pupils are drawn in a circular eye contour. In the eyes with closed eyelids 124*b*, the eyelids are represented by downwards convex circular arcs. The mouth with opened lips 125*a* is expressed in the form of a longitudinally disposed crescent. In the mouth with closed lips 125*b* the mouth is represented by a downwards convex circular arc as in the eyes with closed eyelids 124*b*.

In the first embodiment, for the expression of the eyes 124 which will most attract attention of the user in the face pictogram 120, an image drawn using a first circle and a second circle in the first circle in which centers of these circles are at mutually different positions and an image drawn using the downwards convex circular arcs are presented for the adjacent two buttons constituting the Open/close button 53. Resultantly, the state change between the opened eyes and the closed eyes can be clearly contrasted. By changing the positions of the pupils, the state change can be expressed to advantageously guide the operation. Also, by presenting the mouth with opened lips 125*a* and the mouth with closed lips 125*b* in addition to the expression of the eyes 124, the state change of the face pictogram 120 can be more strongly expressed to the user. It is also possible to employ a large-sized face and a small-sized face for the face pictogram 120. This helps the user more easily learn the images and more clearly recognize the state changes.

Next, referring to FIGS. 13 to 23, description will be given of results of experiments conducted to verify efficiency of the pictogram 100 described in conjunction with FIGS. 3 to 12.

Figure 28:
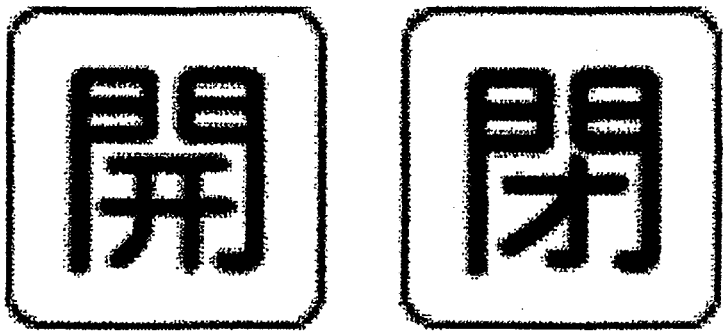
FIG. 28 is a schematic diagram showing pictograms of the prior art.
Figure 28:
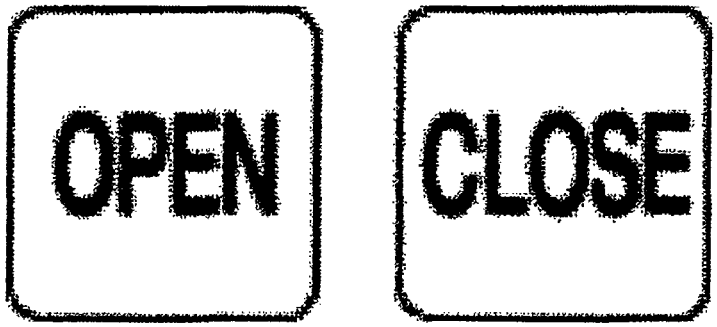
Figure 28:
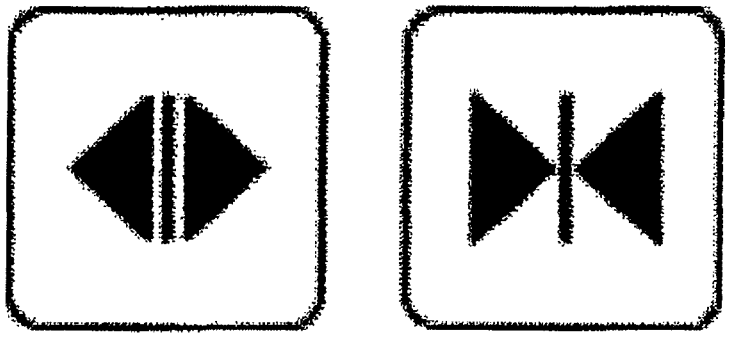

The experiments are conducted using a combination pictogram 150 of an overall image pictogram 130 shown in FIGS. 9 and 10, an arrow pictogram of a conventional example shown in FIG. 28 (*c*), Japanese characters shown in FIG. 28 (*a*), an operation pictogram 160 shown in FIGS. 5 and 6, a combination pictogram 150 of a face pictogram 120 shown in FIGS. 7 and 8, a face pictogram 120 of FIGS. 3 and 4, and English letters shown in FIG. 28 (*b*).

Figure 13:
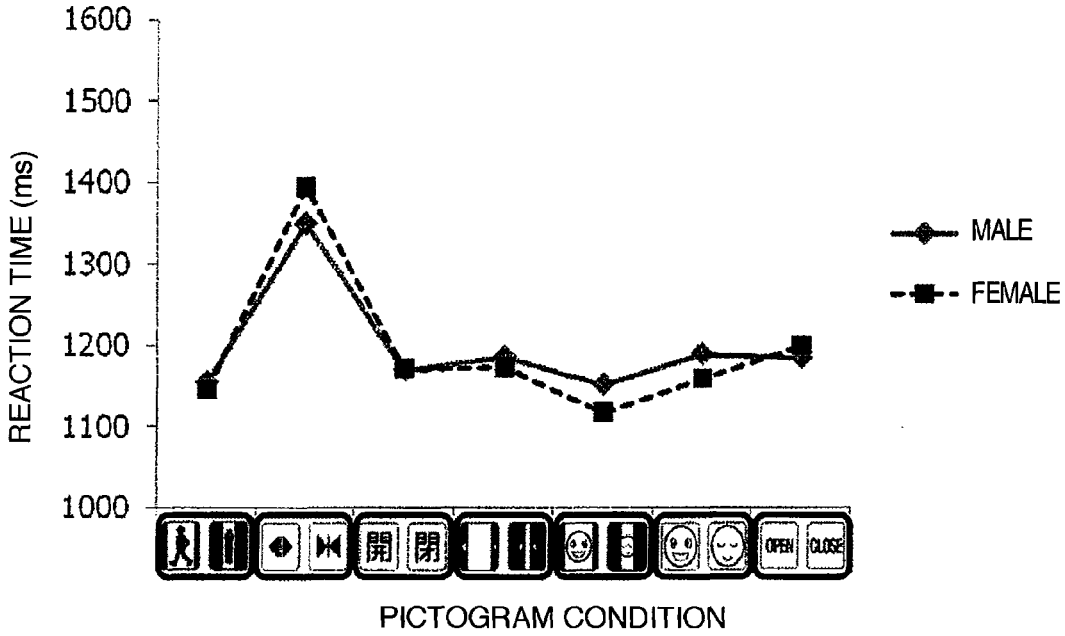
FIG. 13 is a graph showing an experimental result of pictograms according to the embodiment.
Figure 14:
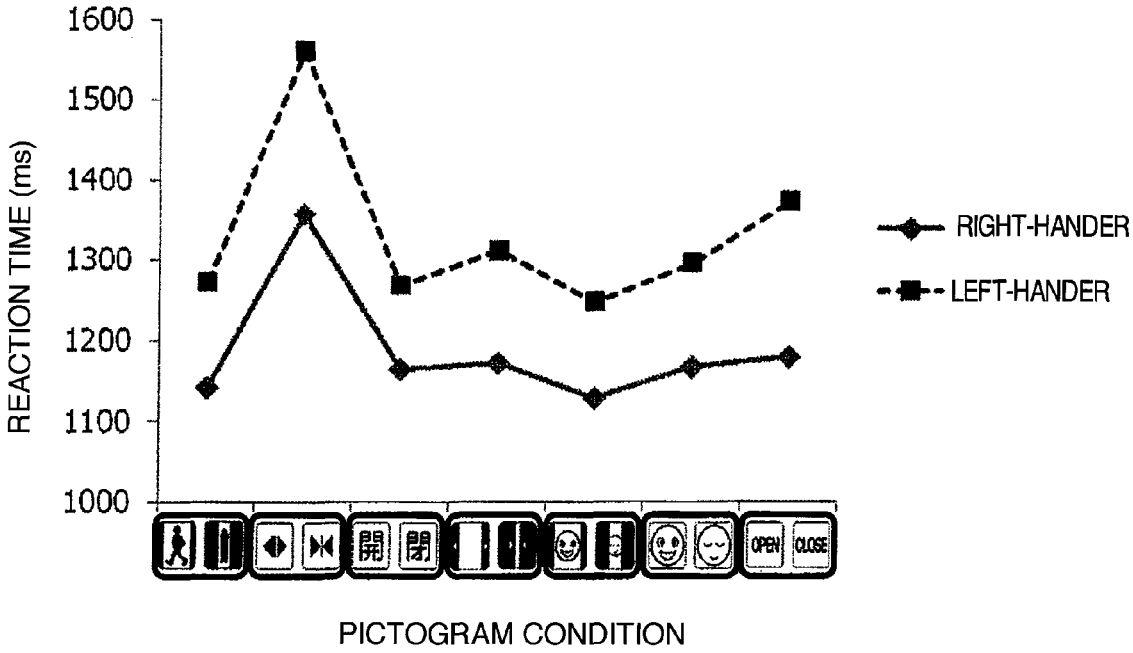
FIG. 14 is a graph showing an experimental result of pictograms according to the embodiment.
Figure 15:
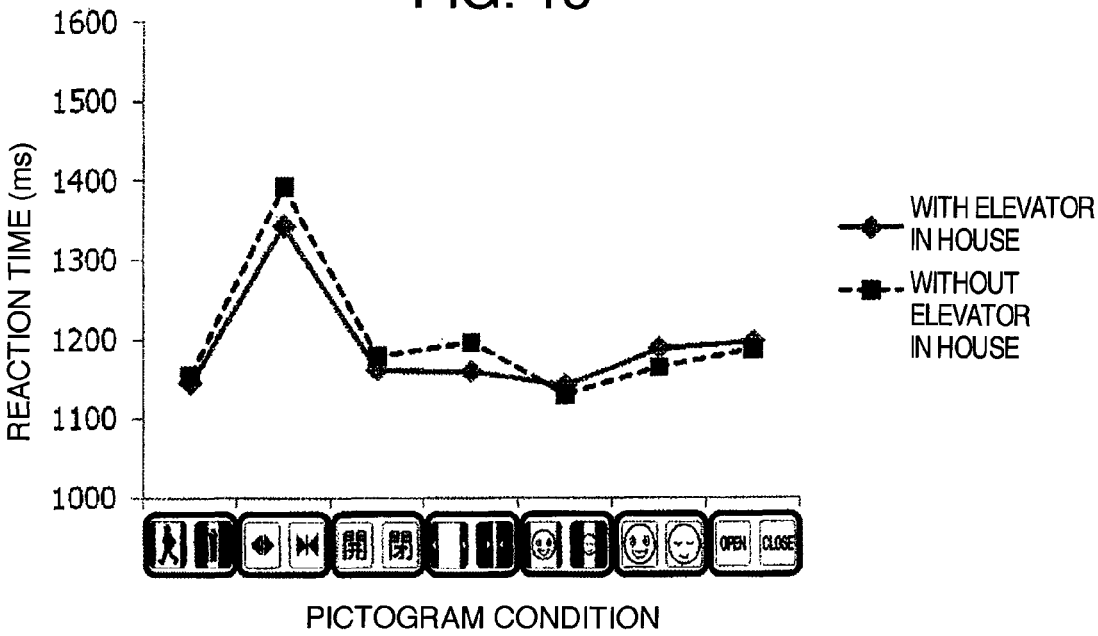
FIG. 15 is a graph showing an experimental result of pictograms according to the embodiment.
Figure 16:
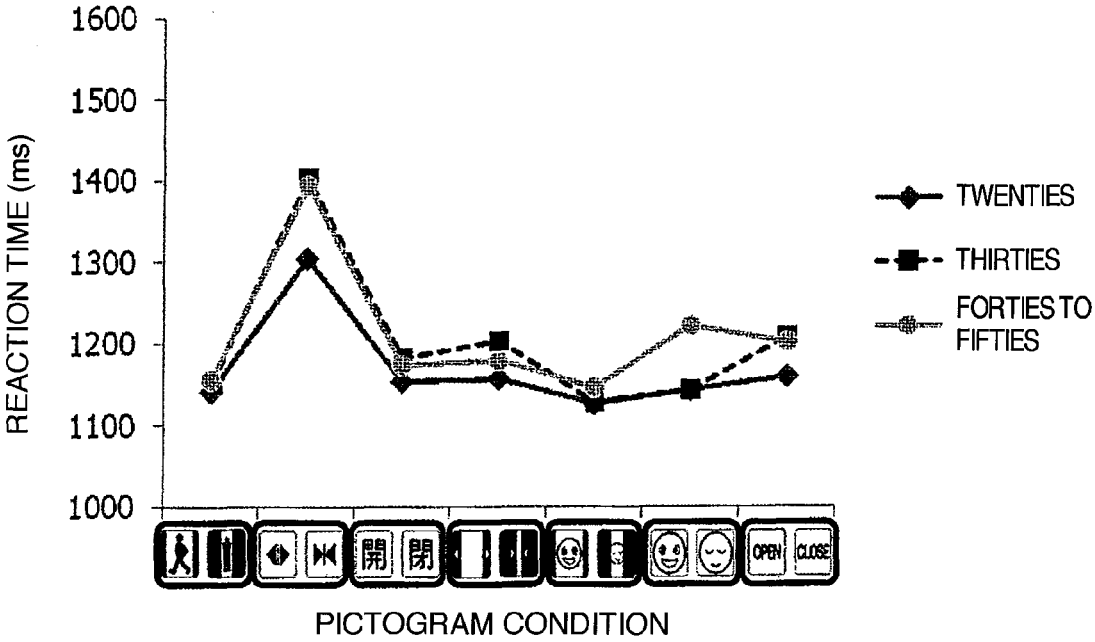
FIG. 16 is a graph showing an experimental result of pictograms according to the embodiment.
Figure 17:
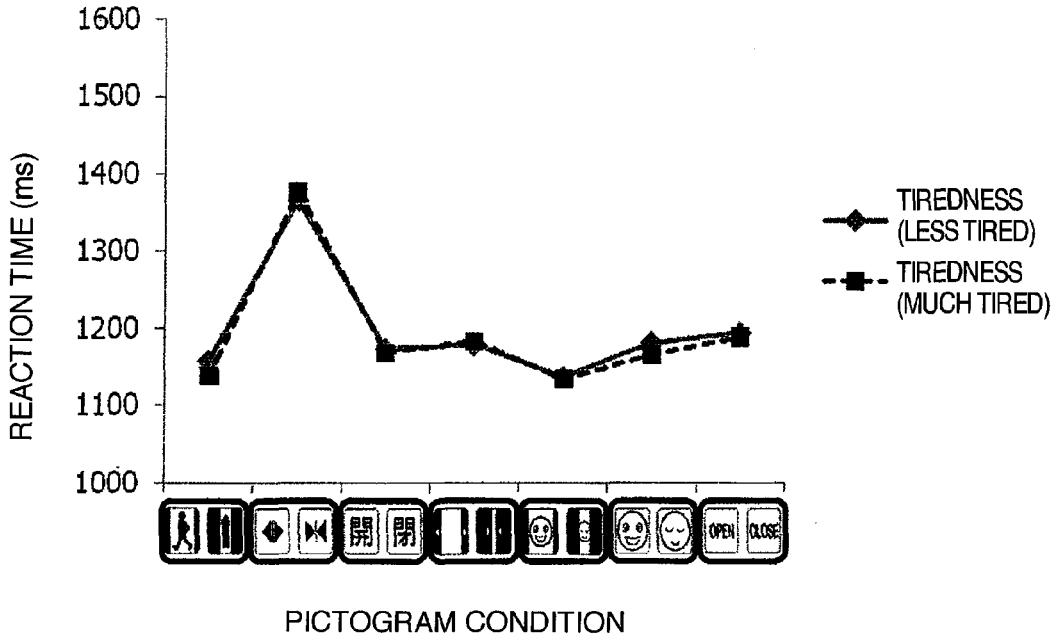
FIG. 17 is a graph showing an experimental result of pictograms according to the embodiment.
Figure 18A:
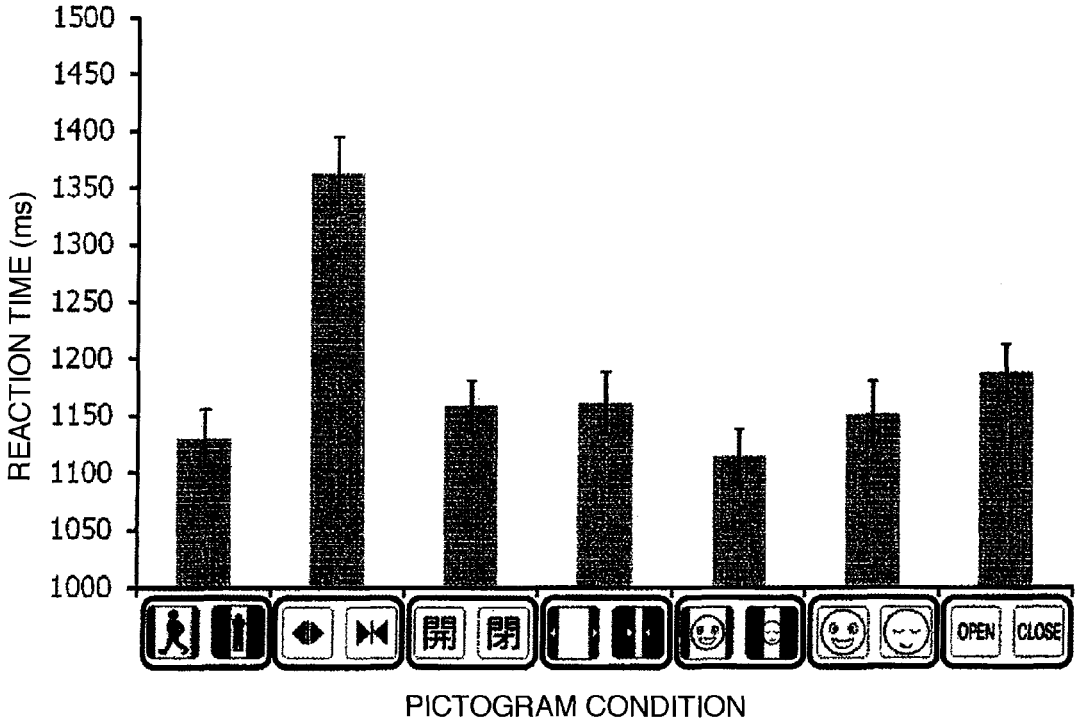
FIG. 18A is a graph showing an experimental result of the reaction time for respective pictograms of the embodiment.
Figure 18B:
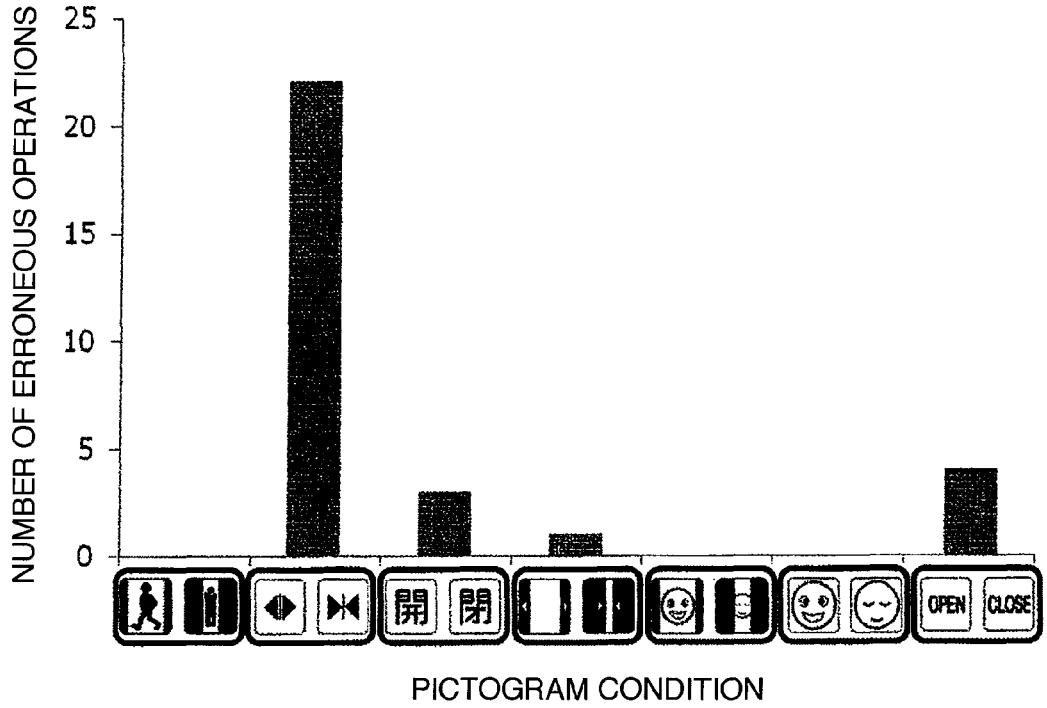
FIG. 18B is a graph showing an experimental result of the number of erroneous operations for pictograms of the embodiment.
Figure 18C:
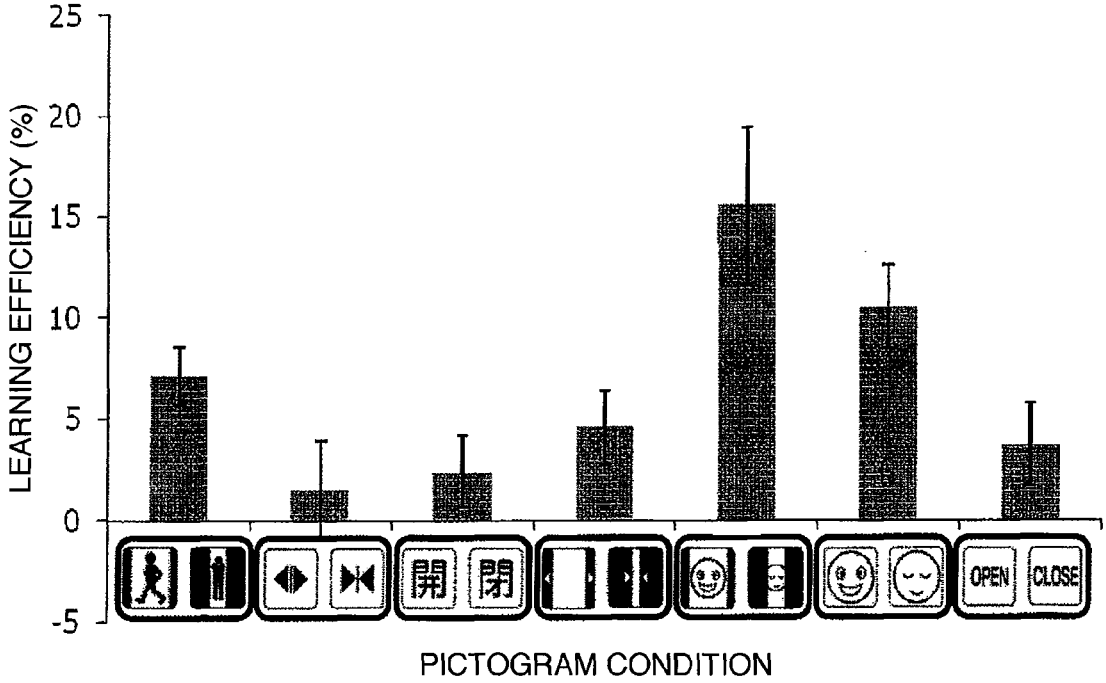
FIG. 18C is a graph showing an experimental result of the learning efficiency for pictograms of the embodiment.
Figure 19A:
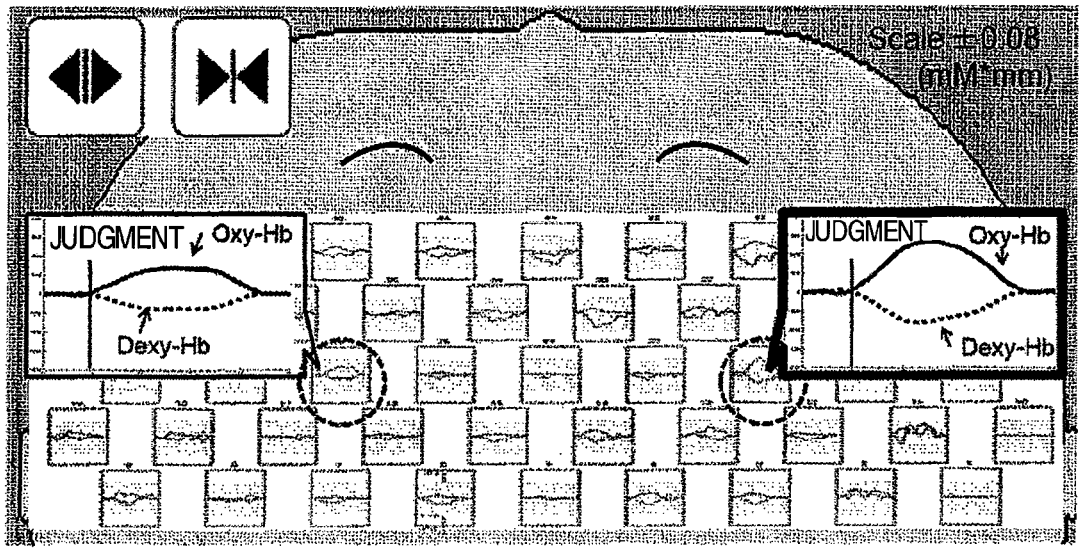
FIG. 19A is a graph showing an experimental result of pictograms of the embodiment.
Figure 19B:
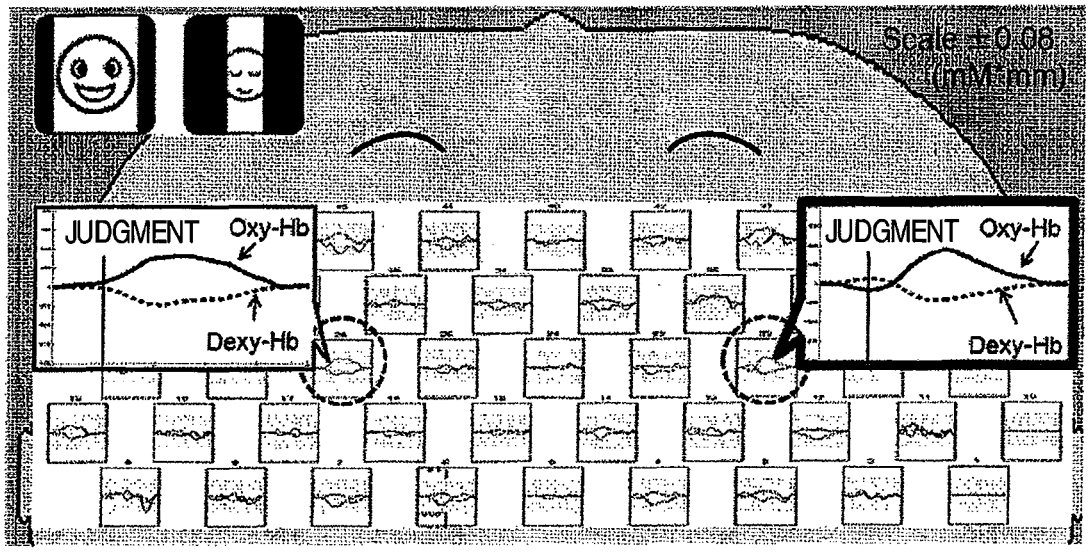
FIG. 19B is a graph showing an experimental result of pictograms of the embodiment.

FIG. 13 is a graph showing results of the reaction time according to the sex of the subject. FIG. 14 graphically shows results of the reaction time for the dominant hand of the subject. FIG. 15 is a graph showing results of the reaction time depending on whether or not the subject has an elevator in his or her house. FIG. 16 graphically shows results of the reaction time for the age of the subject. FIG. 17 is a graph showing results of the reaction time depending on subjective tiredness of the subject. FIG. 18A graphically shows experimental results of the reaction time of the subject. FIG. 18B is a graph showing experimental results of the number of incorrect operations. FIG. 18C graphically shows experimental results of learning efficiency. FIGS. 19A and 19B show changes in the brain activity of the subject. In FIG. 13 to FIGS. 21A and 21B, the reaction time is represented in units of 1/1000 second. The bar chart shows an average reaction time for all samples. A vertical line drawn at the top of the bar indicates the upper and lower limits of the standard error of the average reaction time.

Description will now be specifically given of the experiments conducted using the seven pictograms or characters or letters. The Open/close button with these pictograms or characters or letters is presented on a display including a touch panel in the form in which the button is applied to the actual operation panel 50. To the subject, a voice indication "open" or "close" is given. In response thereto, the subject touches the Open/close button, and the reaction time required to touch the button is measured. The Open/close button presented on the display with the touch panel is similar to that of the prior art. That is, the button includes a pair of buttons which are substantially equal in size and which are installed horizontally arranged adjacent to each other. Specifically the Open button is on the left side and the Close button is on the right side. The display screen is apart from the subject from about 40 centimeters (cm) to about 50 cm as in an actual elevator apparatus.

The Open/close button is presented on the display for about two seconds and then is cleared, and the cleared state, i.e., the Open/close button non-display state continues for about three seconds. The voice indication is given to the subject during the Open/close button non-display state of three seconds. The voice indications "open" and "close" are repeatedly produced ten times for each pictogram in a random order. To prevent the subject from learning the meaning of each button on the basis of the position thereof, the buttons are also randomly displayed on the right and left sides. (For example, the state in which "open button" is on the right side and "close button" is on the left side and the state in which "open button" is on the left side and "close button" is on the right side are displayed in a random order.) The experiments are conducted for 30 samples. The reaction time is a period of time from when the button is displayed on the screen to when the subject touches the display. The number of incorrect operations indicates the number of erroneous operations to push the Open/close button in the experiment. The learning efficiency is defined as follows. The entire trials are divided into four zones. The learning efficiency is represented by a rate of change in the reaction time in a range from the first zone to the fourth zone.

FIG. 13 shows that the reaction time little varies between the sexes. The reaction time is long as about 1.3 seconds (sec) for the conventional pictograms. For the other pictograms, the reaction time ranges from about 1.1 sec to about 1.2 sec.

FIG. 14 shows that the reaction time of the left-hander is longer than that of the right-hander. The reaction time little varies with respect to the different pictograms of the invention. The reaction time is not satisfactory for the conventional pictograms. Good results are obtained for the other pictograms.

According the experimental results shown in FIG. 15, the reaction time little varies depending on whether or not the subject has an elevator in his or her house.

FIG. 16 shows the reaction time for subjects of the twenties, the thirties, and the group ranging from forties to fifties. It is confirmed that the reaction time is naturally shorter for the younger generation. This tendency little changes among the three groups.

FIG. 17 shows influence of subjective tiredness of the subjects upon the reaction time. The reaction time little varies between the subjects whose tiredness ranges from "not tired" to "tired".

In FIG. 18A, the reaction time is shortest for the combination pictogram 150 including the face pictogram 120 and the door pictogram 160*a*. Specifically, the average reaction time is about 1.11 sec. The reaction time is second shortest for the combination pictogram 150 including the overall image pictogram 130 and the door pictogram 160*a*. Concretely, the average reaction time is about 1.13 sec. The reaction time is third shortest for the face pictogram 120. That is, the average reaction time is about 1.15 sec. The reaction time is fourth shortest for the Japanese characters. Concretely, the average reaction time is about 1.15 sec. The reaction time is fifth shortest for the door pictogram 160*a*. Specifically, the average reaction time is about 1.16 sec. The reaction time is sixth shortest for the English letters. That is, the average reaction time is about 1.18 sec. The longest reaction time is required for the conventional pictogram, namely, about 1.36. The shortest reaction time for the combination pictogram 150 including the face pictogram 120 and the door pictogram 160*a* is about 20% less as compared with the longest reaction time.

In FIG. 18B, the number of erroneous operations with the modulus set to 300 is zero for the human pictogram 110 and the combination pictogram 150. The number of erroneous operations is largest for the conventional pictogram, namely, 22. The number of erroneous operations is 4, 3, and 1 respectively for the English letters, the Japanese characters, and the operation pictogram 160. The results are quite important and imply that the identifiability is remarkably improved by employing the human pictogram 110.

In FIG. 18C, the learning efficiency is highest for the combination pictogram 150 including the face pictogram 120 and the door pictogram 160*a*. The learning efficiency is second highest for the face pictogram 120, third highest for the combination pictogram 150 including the overall image pictogram 130 and the door pictogram 160*a*, fourth highest for the door pictogram 160*a*, fifth highest for the English letters, and sixth highest for the Japanese characters. The learning efficiency is lowest for the conventional pictogram. The highest learning efficiency of the combination pictogram 150 including the face pictogram 120 and the door pictogram 160*a* is about ten times the lowest learning efficiency of the conventional pictogram.

Next, it is experimentally examined how the combination pictogram 150 including the face pictogram 120 and the door pictogram 160*a* with the shortest reaction time and with no erroneous operation and the conventional pictogram with the longest reaction time and with the largest number of erroneous operations affect functions of the human brain.

For the measurement on a living body by use of light, an apparatus to measure functions of a living body by using light ranging from visible light to near infrared light has been described, for example, in JP-A-57-115232 or JP-A-63-275323. In addition, JP-A-9-98972 describes an invention associated with an image measuring technique for brain functions using the measurement principle. In the experiment, a change in the brain activity of the frontal region is measured by using the living body optical measuring method. The change in the brain activity attained using the living body optical measuring method is a change in the blood flow rate in the brain, specifically, a change in the density of OxyHemoglobin (Oxy-Hb) or DeoxyHemoglobin (Deoxy-Hb).

The frontal region of the brain is a region called the "frontal lobe" and serves advanced functions such as memorization, recognition, judgment, and learning. The frontal lobe has important functions to control activities in which a result of the visual information process is received, the result is recognized to be judged, and an associated operation is conducted. In the experiment, 47 brain activity changes are measured in the brain regions ranging from the frontal lobe to the temporal lobe. After the voice indication "open" or "close" is given to the subject, pictograms are displayed. The subject selects a pictogram conforming to the voice indication and then pushes a button at hand.

The test is conducted ten times for each pictogram in a random way. To prevent the subject from learning the meaning of each button on the basis of the position thereof, the buttons are also randomly displayed on the right and left sides. (For example, the state in which the "open button" is on the right side and the "close button" is on the left side and the state in which the "open button" is on the left side and the "close button" is on the right side are displayed in a random order.) The experiments are conducted for 3 samples. The reaction time is a period of time from when the button is displayed on the screen to when the subject pushes the reaction button at hand. The number of erroneous operations indicates the number of incorrect operations to push the Open/close button in the experiment.

FIGS. 19A and 19B show results of the experiments. The judging point of time indicates a point of time when the pictogram is displayed. FIG. 19A shows the brain activity change at judgment of the opening and closing operations for the conventional pictogram. FIG. 19B shows the brain activity change at judgment of the opening and closing operations for the combination pictogram. Each of FIGS. 19A and 19B shows a representative waveform at a left-side position and a right-side position. According to FIGS. 19A and 19B, it can be confirmed that the change in Oxy-Hb in the front-right region of the brain is larger for the opening and closing operation judgment of the conventional pictogram than for that of the combination pictogram.

For the conventional pictogram, the reaction time is longer and an erroneous reply frequently takes place. It is hence considered that the subject unwillingly and mistakenly recognizes the meaning of the patterns, and conflict for decision repeatedly occurs in the brain. Such a psychological phenomenon is called "recognitive conflict". It is known that the brain activity is more intensive in this state. It can be assumed that the experimental results are affected by the recognitive conflict taking place due to mismatching between the meanings of the patterns. On the other hand, the combination pictogram has high identifiability and is easy to lean. Hence, the recognitive conflict does not occur and the load imposed upon the recognition process in the brain is mitigated.

As can be seen from the experimental results, although the conventional pictogram has been broadly employed, the reaction time thereof is longer than that of the other pictograms in the experiments. As FIG. 18B shows, the number of erroneous operations is larger for the conventional pictogram as compared with the other pictograms. Japanese characters and English letters are not suitable for pictograms to be used worldwide due to the hindrance in use thereof in many countries. It can be hence confirmed that the pictograms proposed in the embodiment are remarkably efficient with respect to visibility and identifiability when compared with the conventional pictograms. Particularly, according to the experiments conducted using the human pictogram 110 provided with the mutually different state changes corresponding to "opening operation" and "closing operation" assigned respectively to the constituent buttons of the Open/close button 53, it can be detected that the number of incorrect operations is lowered, and visibility and identifiability are improved in association with the reaction time as shown in FIGS. 18A to 18C. Since the recognitive conflict does not take place, the load imposed on the recognition process in the brain is reduced. Also, when the human pictogram 110 with the mutually different state changes is combined with the operation pictogram 160, visibility and learning efficiency are improved. Further, when the face pictogram 120 is employed as the basic element, visibility and learning efficiency are much more improved.

Figure 20A:
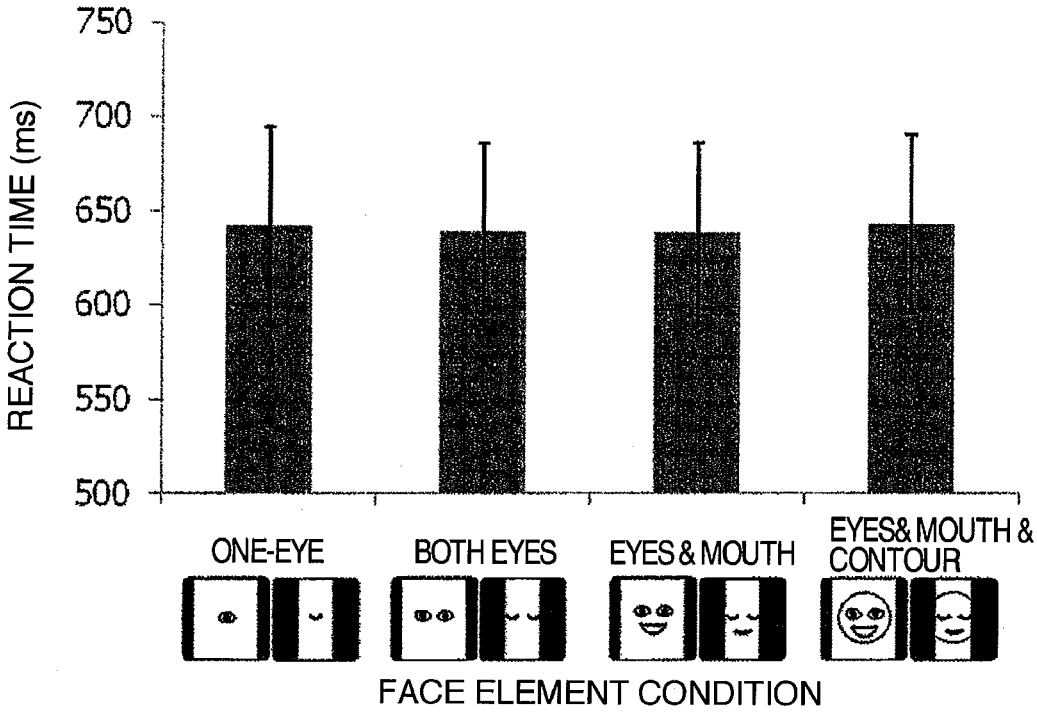
FIG. 20A is a graph showing an experimental result of pictograms of the embodiment.
Figure 20B:
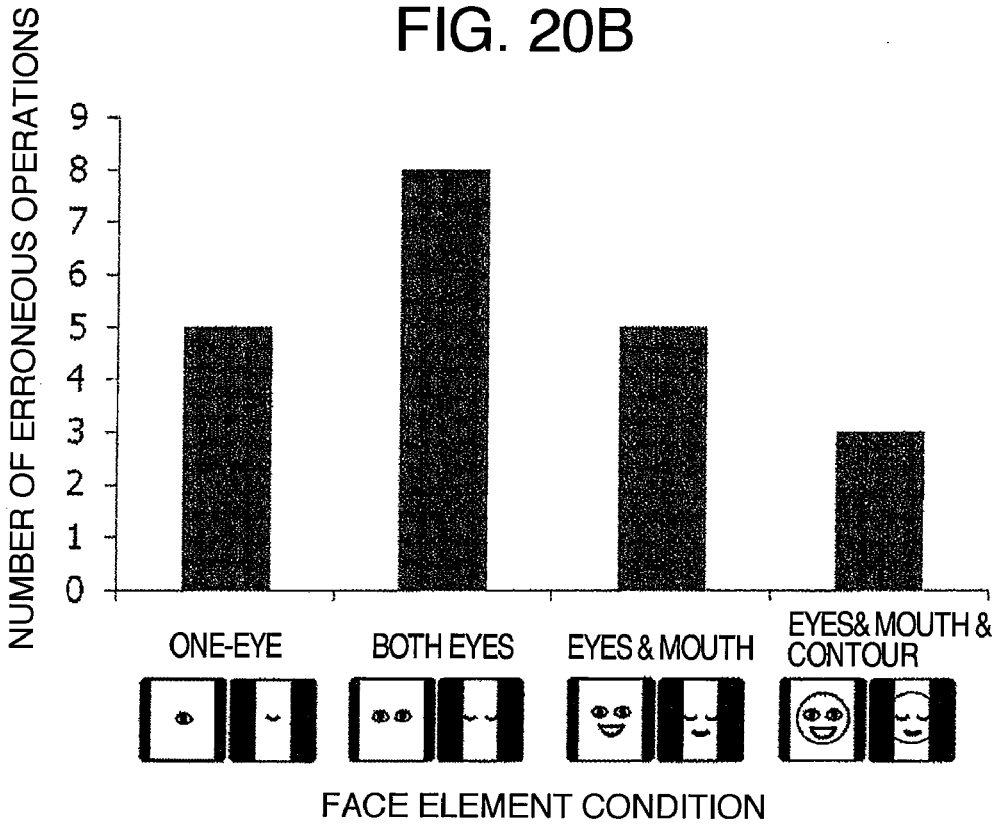
FIG. 20B is a graph showing an experimental result of pictograms of the embodiment.

How the subject recognizes the face contour 123, the eyes 124, and the mouth 125 as constituent elements or parts of the face pictogram 120 is experimentally verified. FIGS. 20A and 20B show results of the experiments. For ten samples, the measurement is carried output ten times for each pictogram. The number of trials (modulus) is consequently 100.

FIGS. 20A and 20B show experimental results obtained by verifying how the combinations of the elements of the face pictogram 120 affect the reaction time of the subject.

The abscissa represents the combination, i.e., "only one eye", "both eyes", "both eyes and mouth", and "both eyes, mouth, and contour". The ordinate represents the average reaction time in FIG. 20A and the number of erroneous operations in FIG. 20B. According to the experimental results, the reaction time little varies with respect to the constituent elements of the face. The number of erroneous operations is lowest for the condition of "both eyes, mouth, and contour". It is hence desirable that the combination includes the eyes, the mouth, and the contour.

Returning to FIGS. 3 and 4, this embodiment adopts the face pictogram 120 as a combination of the face contour 123, the eyes 124, and the mouth 125 in consideration of pattern identifiability of a combination with the other operation pictogram 160. In the embodiment, a large image of the face pictogram 120 is displayed in the central area of the letter display surface 67 with a slight margin in the periphery thereof.

Referring to FIGS. 5 and 6, a door pictogram 160*a* is employed as the operation pictogram 160 in the embodiment. The door pictogram 160*a* includes a pair of door images 163, a space section 164 arranged between the door images 163, and direction marks 165 disposed in the door images 163. In the embodiment, the letter display surface 67 is vertically divided into three partitions, i.e., the space section 164 as the central partition and the door images 163 on both sides of the space section 164. The space section 164 is displayed in white or a bright color. Contrarily, the door images 163 are displayed in black or a dark color. Hence, the space section 164 seems to be a space which is viewed between the door 22 (the door images 163). For the direction mark 165, a triangular mark one vertex of which faces outside indicates an opening direction and a triangular mark one vertex of which faces inside indicates a closing direction. The direction mark 165 is installed at a vertically central position of the door image 163, the position being nearer to the space section 164 than to the associated edge of the pictogram 160*a*. The direction mark 165 is also displayed in white or a bright color in contrast to the color of the door image 163.

In the door pictogram 160*a* according to the embodiment, the state change is expressed by a change in the size of the space section 164. Concretely, the state change is determined by use of a ratio between the space section 164 of the open door pictogram 161*a* and that of the closed door pictogram 161*b* in the letter display surface 67. As FIG. 5 shows, in the open door pictogram 161*a*, the space section 164 takes a wide area and the direction marks 165 outwardly face mutually opposite directions. On the other hand, in the closed door pictogram 161*b*, the space section 164 takes a narrow area and the direction marks 165 inwardly face mutually opposite directions as shown in FIG. 6.

According to the embodiment, since the open and closed door pictograms 161*a* and 161*b* are installed respectively in the constituent two buttons of the Open/close button, the difference in the ratio between the non-space section 163 and the space section 164 provides the user with sufficient identifiability. The inventors have experimentally determined the most efficient ratio between the space section 164 of the open door pictogram 161*a* and that of the closed door pictogram 161*b*. Description will be given of results of the experiments by referring to FIGS. 21A and 21B.

Figure 21A:
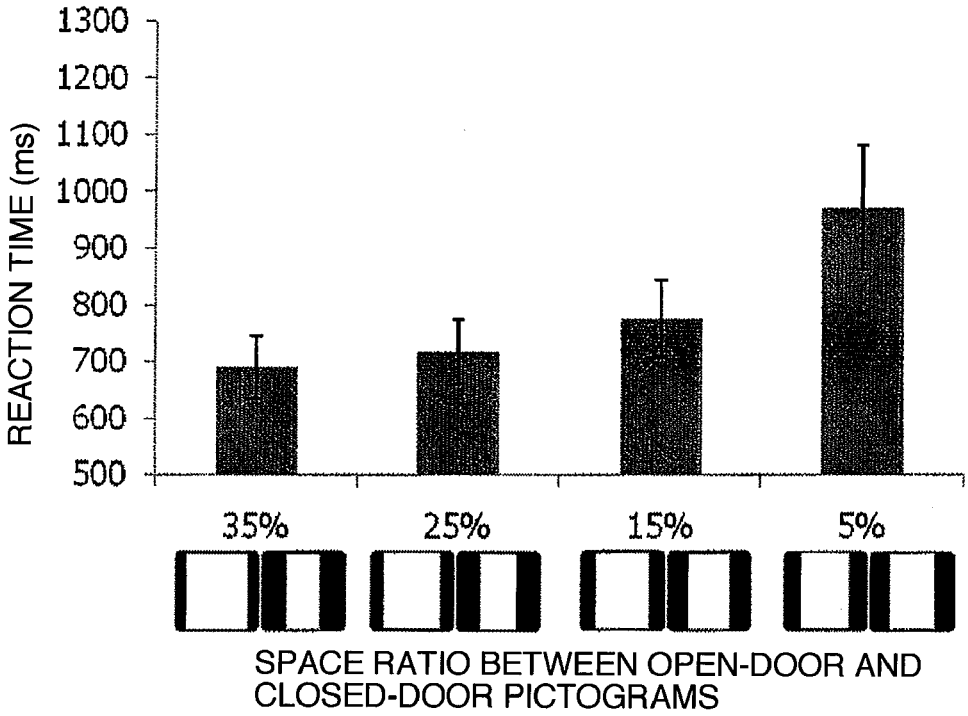
FIG. 21A is a graph showing an experimental result of pictograms of the embodiment.
Figure 21B:
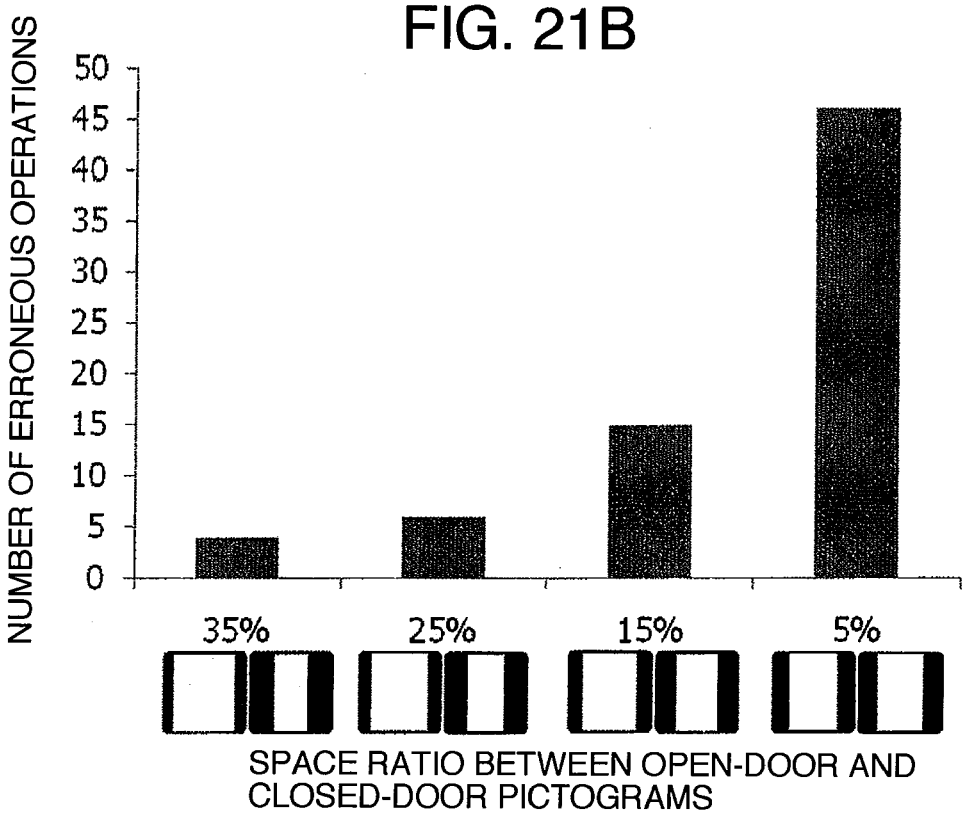
FIG. 21B is a graph showing an experimental result of pictograms of the embodiment.

FIGS. 21A and 21B graphically show experimental results of the reaction time and the number of erroneous operations of the subject in association with the difference in the ratio between the space section 164 of the open door pictogram 161*a* and that of the closed door pictogram 161*b* in the letter display surface 67. The abscissa indicates the difference in the ratio between the space section 164 of the open door pictogram 161*a* and that of the closed door pictogram 161*b*. Specifically, points of 35%, 25%, 15%, and 5% are indicated in the graphs. The ordinate represents the reaction time or the number of erroneous operations.

As can be seen from the experimental results, when the difference in the ratio between the space section 164 of the open door pictogram 161*a* and that of the closed door pictogram 161*b* is less than 15%, the reaction time becomes longer. In contrast thereto, when the difference is equal to or less than 15%, the reaction time little varies. The number of errors remarkably increases when the difference is less than 15%. In consideration of the experimental results, the difference in the ratio between the space section 164 of the open door pictogram 161*a* and that of the closed door pictogram 161*b* is set to at least 15%. However, when the ratio of the space section 164 is 100%, there cannot be created a pictogram in which the door 22 is opened. Hence, the difference in the ratio is favorably set to a value less than 100%, for example, to 90%.

When the operation panel 50 of FIG. 1 is a liquid-crystal touch panel, control may be performed such that the states of the opening operation and the closing operation with the difference in the ratio not below 15% are displayed in the form of animations. Since mobile images of the opening and closing operations are displayed, recognizability is further improved.

The animation display may be employed during the operation of the elevator apparatus. However, to save power, the controller may carry out a control operation as below. The animation display is not conducted if no user exists for the elevator or if the utilization frequency is low in a situation wherein, for example, the elevator cage is moving upward or downward. During a period of time when the utilization frequency will take the largest value, for example, when passengers are getting on or off the elevator (the cage is staying at an associated floor) or immediately before, e.g., several seconds (ranging from about one second to about five seconds) before the cage stops at the target floor, it is efficient to perform the control operation to carry out the animation display.

On the other hand, if the ratio of the space section 164 is too small in the closed door pictogram 161*b*, the letter display surface 67 is almost entirely occupied by the dark door images 163. This conspicuously deteriorates identifiability of the closed door pictogram 161*b*. If the door images 163 are displayed in a dark color, cooperativity thereof with the open door pictogram 161*a* is reduced. In this embodiment, the ratio of the space section 164 is hence set to one third or less of the letter display surface 67.

Figure 22A:
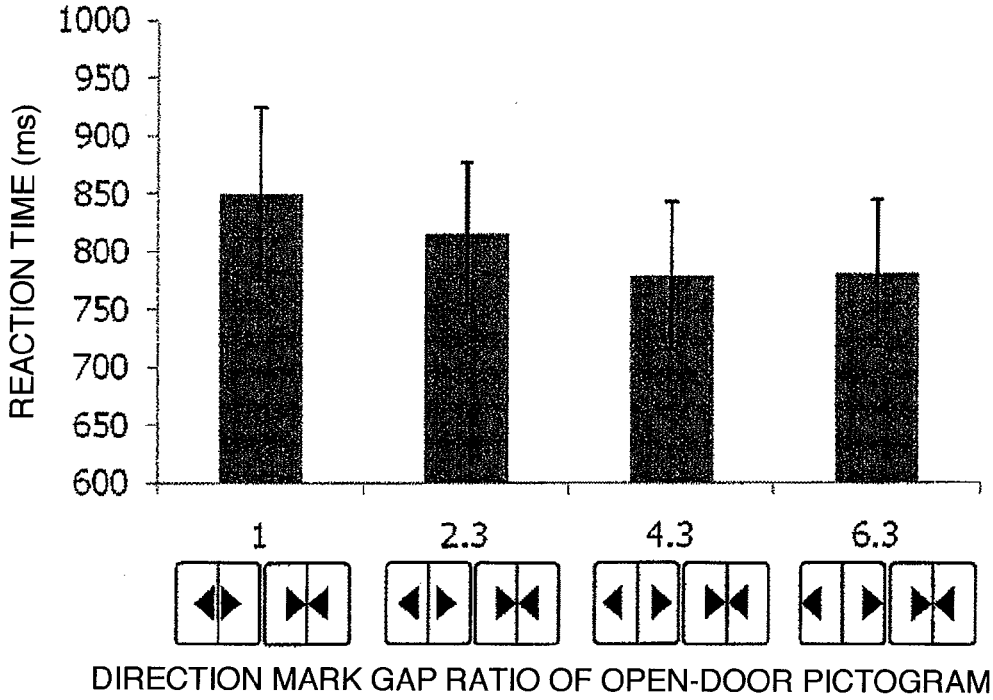
FIG. 22A is a graph showing an experimental result of pictograms of the embodiment.
Figure 22B:
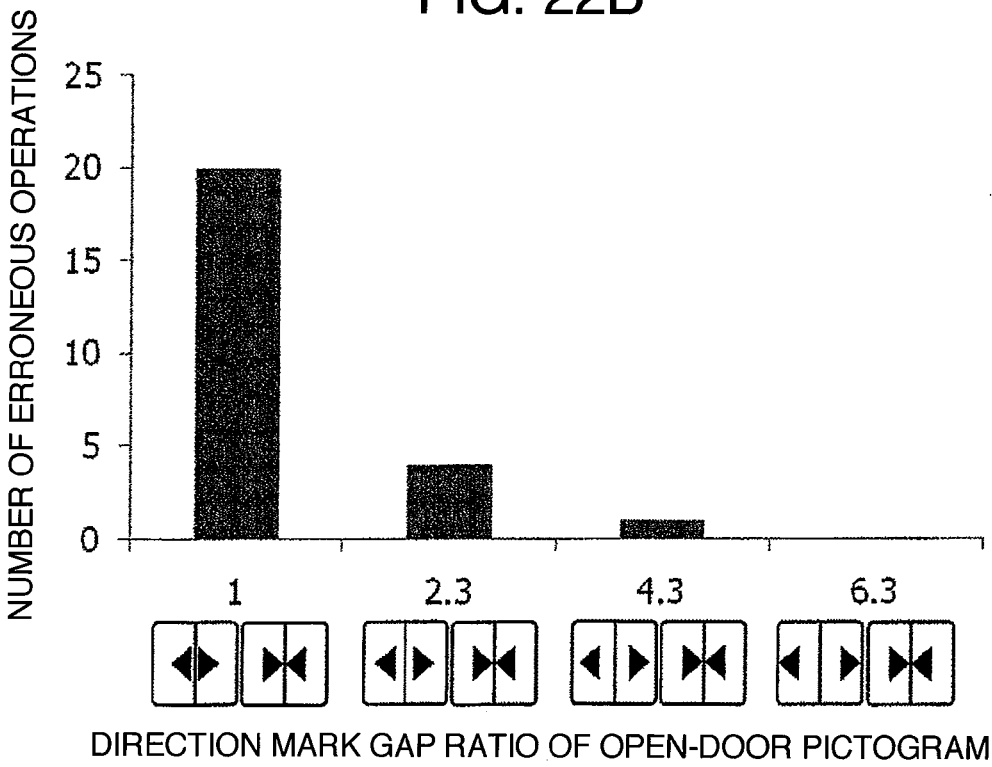
FIG. 22B is a graph showing an experimental result of pictograms of the embodiment.

FIGS. 22A and 22B show in graphs experimental results of the reaction time and the number of erroneous operations of the subject with respect to the change in the gap ratio of the gap between the direction marks 165. The state of the direction marks 165 of FIG. 11 is changed to the state shown in FIG. 12. Assuming that the horizontal width 170 of the letter display surface 67 is represented as 100%, the gap ratio of the gap between the direction marks 165 to the horizontal width 170 is changed as 1, 2.3, 4.3, and 6.3. As can be seen from the verification results, the reaction time little varies with respect to the ratio of the gap between the direction marks 165 to the horizontal width 170. However, according to FIG. 22B showing the number of erroneous operations based on "modulus=100", the number of erroneous operations is 20 for the gap ratio of 1, four for the gap ratio of 2.3, one for the gap ratio of 4.3, and zero for the gap ratio of 6.3. According to the verification results, in the open door pictogram, the gap ratio of the direction marks 165 is desirably set to 2.3 or more.

FIGS. 7 and 8 show top views of the pushing sections respectively provided with an open combination pictogram and a close combination pictogram created using the face pictograms shown in FIGS. 3 and 4 and the door pictograms shown in FIGS. 5 and 6. FIG. 7 shows an appearance of the pushing section with the open combination pictogram. FIG. 8 shows an appearance of the pushing section with the close combination pictogram.

In the embodiment of FIGS. 7 and 8, the letter display surface 67 is divided into three partitions. The central partition is assumed as the space section 164. Two partitions on both sides of the space section 164 are set as the door images 163. The face pictogram 120 is arranged in a central area of the letter display surface 67 and a central area of the space section 164. In this embodiment, the space section 164 of the open combination pictogram 151 shown in FIG. 7 is configured such that the difference in the ratio between the space section 164 of the open door pictogram 161*a* and that of the closed door pictogram 161*b* is 15% or more.

In the open combination pictogram 151 of FIG. 7, since the space section 164 can occupy a sufficiently large area, a large space may be arranged in the periphery of the open-eye face pictogram 121. However, in the close combination pictogram 152 of FIG. 8, the space section 164 cannot occupy such large area. Hence, in this embodiment, the closed-eye face pictogram 122 is reduced in size to be placed in the space section 164. In this case, the pictogram 122 is reduced in size such that the overall image of the pictogram 122 is placed in the space section 164.

Figure 23:
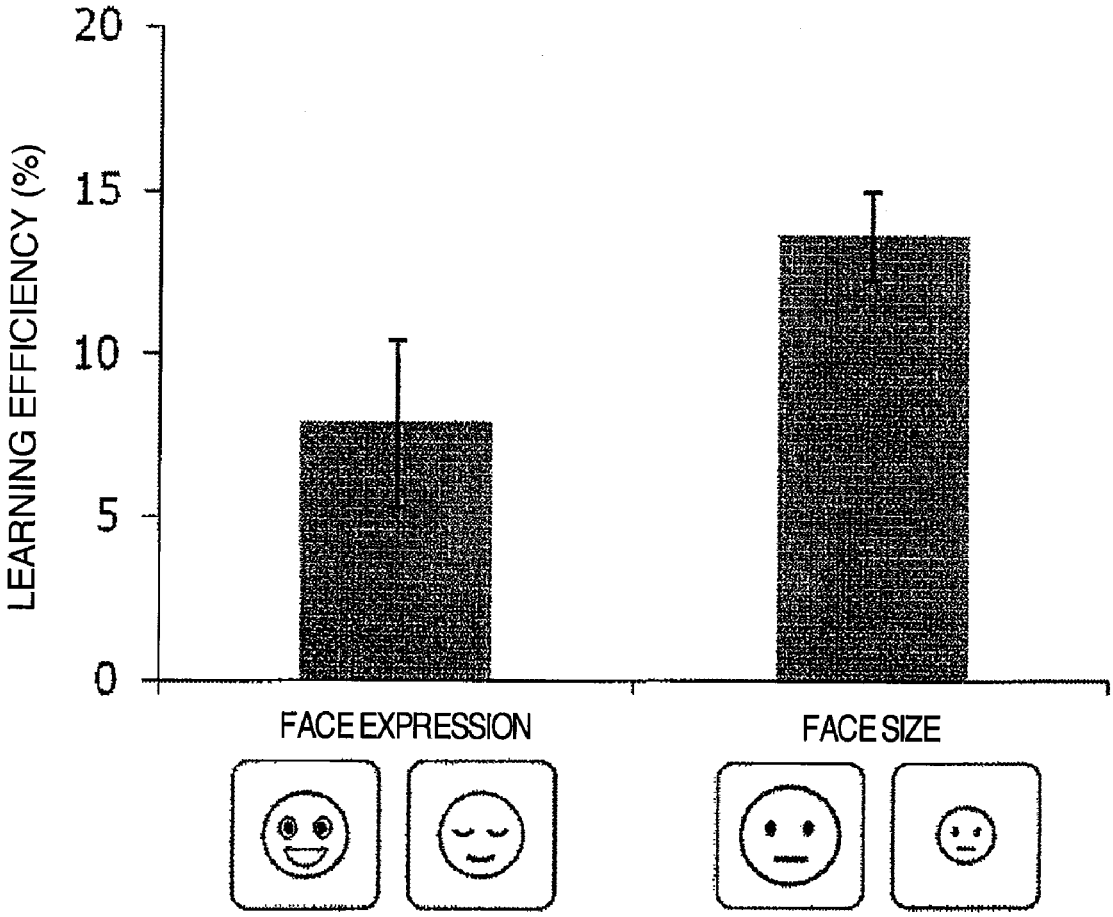
FIG. 23 is a graph showing an experimental result of pictograms of the embodiment.

In the embodiment, the pictogram is reduced in size such that the eyes 124 and the mouth 125 are placed in the space section 164. As a result, both sides of the face contour 123 are lost. FIG. 23 shows experimental results of the learning efficiency for the pictograms representing the opening and closing operations by use of face expressions and the pictograms representing the opening and closing operations by use of the large and small sizes of the face, without using face expressions. The number of samples is 20. According to the experimental results, the size of the face remarkably affects the learning efficiency. It is hence possible to reduce the face in size in the closed-eye face pictogram.

Although no direction mark 165 is arranged in this embodiment, visibility and identifiability can be improved by disposing the direction marks 165 as shown in FIG. 5.

FIGS. 9 and 10 show top views of the pushing sections respectively provided with an open combination pictogram and a close combination pictogram, the open and close combination pictograms being created by use of face pictograms representing human operations and operation pictograms. FIG. 9 shows an appearance of the pushing section with the open combination pictogram. FIG. 10 shows an appearance of the pushing section with the close combination pictogram.

In the embodiment shown in FIGS. 9 and 10, a door pictogram 160*a* is adopted as the operation pictogram 160. An open door pictogram 161*a* similar in structure to FIG. 7 is used for the open combination pictogram 151*a* of FIG. 9. A close door pictogram 161*b* like FIG. 8 is employed for the close combination pictogram 151*b* of FIG. 10.

The embodiment adopts, in place of the face pictogram 120, an overall image pictogram 130 expressing an overall image of a human operation or posture of a human by use of a silhouette. Contrastive states are displayed for the overall image pictogram 130, that is, "action posture" representing a walking person and "standstill posture" representing a person in a standstill state. The posture of a walking person causes the user to image that the door 22 is opened enough for a passenger to enter the elevator cage. The posture of a standstill person causes the user to image that the door 22 is closed and it is not possible for a passenger to enter the elevator cage.

In the embodiment, an open overall image pictogram 131 concretizing "action posture" expressed by a walking person is combined with the open door pictogram 161*a* to form the open combination pictogram 151*a* for the open button 53*a* shown in FIG. 9. A closed overall image pictogram 132 concretizing "standstill posture" expressed by a person in a standstill state is combined with the closed door pictogram 161*b* to form the closed combination pictogram 151*b* for the close button 53*b* shown in FIG. 10.

In operation of the buttons according to the embodiment, the user recognizes the contrastive overall image pictograms 130 attached to the two adjacent constituent buttons of the Open/close button 53. The user identifies, based on the contrastive state display and the door pictogram 160*a*, that the open combination pictogram 151*a* shown in FIG. 9 indicates the open button 53*a* and the close combination pictogram 151*b* shown in FIG. 10 indicates the close button 53*b*.

Second Embodiment

Referring next to FIGS. 24 to 27, description will be specifically given of another application of the human pictogram 110 according to the second embodiment. In FIGS. 24 to 27, the almost same constituent components and sections as those of FIGS. 1 to 23 are assigned with the same reference numerals, and duplicated description thereof will be avoided. Further, in FIGS. 24 to 27, the letter display surface 67 as an important section (partial design) is indicated by use of bold lines, and the other sections are drawn using broken lines. It is natural that the overall appearance (overall design) drawn by using bold lines is also a novel design. For easy explanation, description will be separately given of the important section and the other sections.

Figure 24:
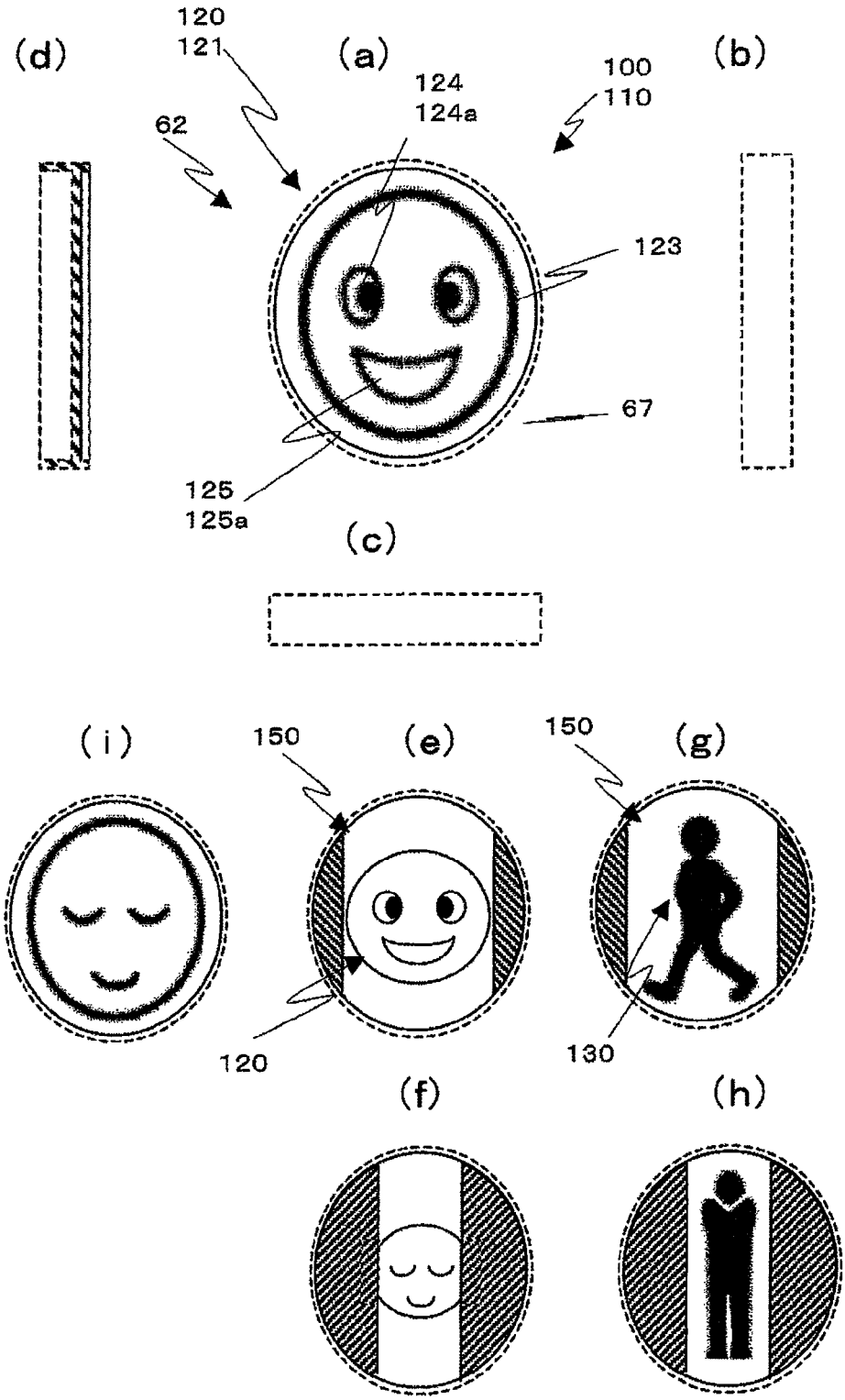
FIG. 24 is a perspective view showing a pushing section of an Open/close button having a circular letter display section according to a second embodiment.
Figure 25:
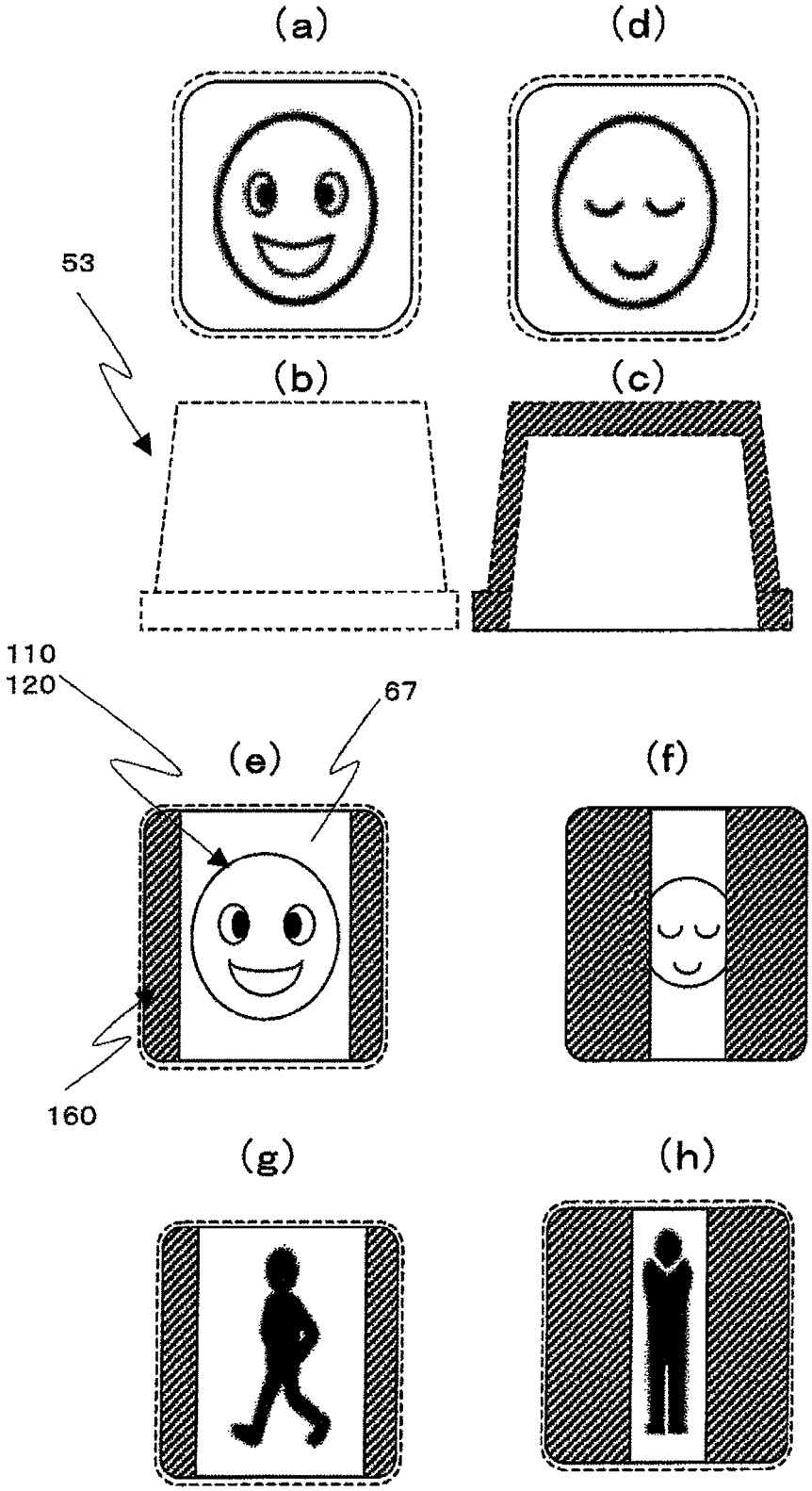
FIG. 25 is a perspective view showing a lamp switch having the shape of a frustum of a pyramid according to the second embodiment.
Figure 26:
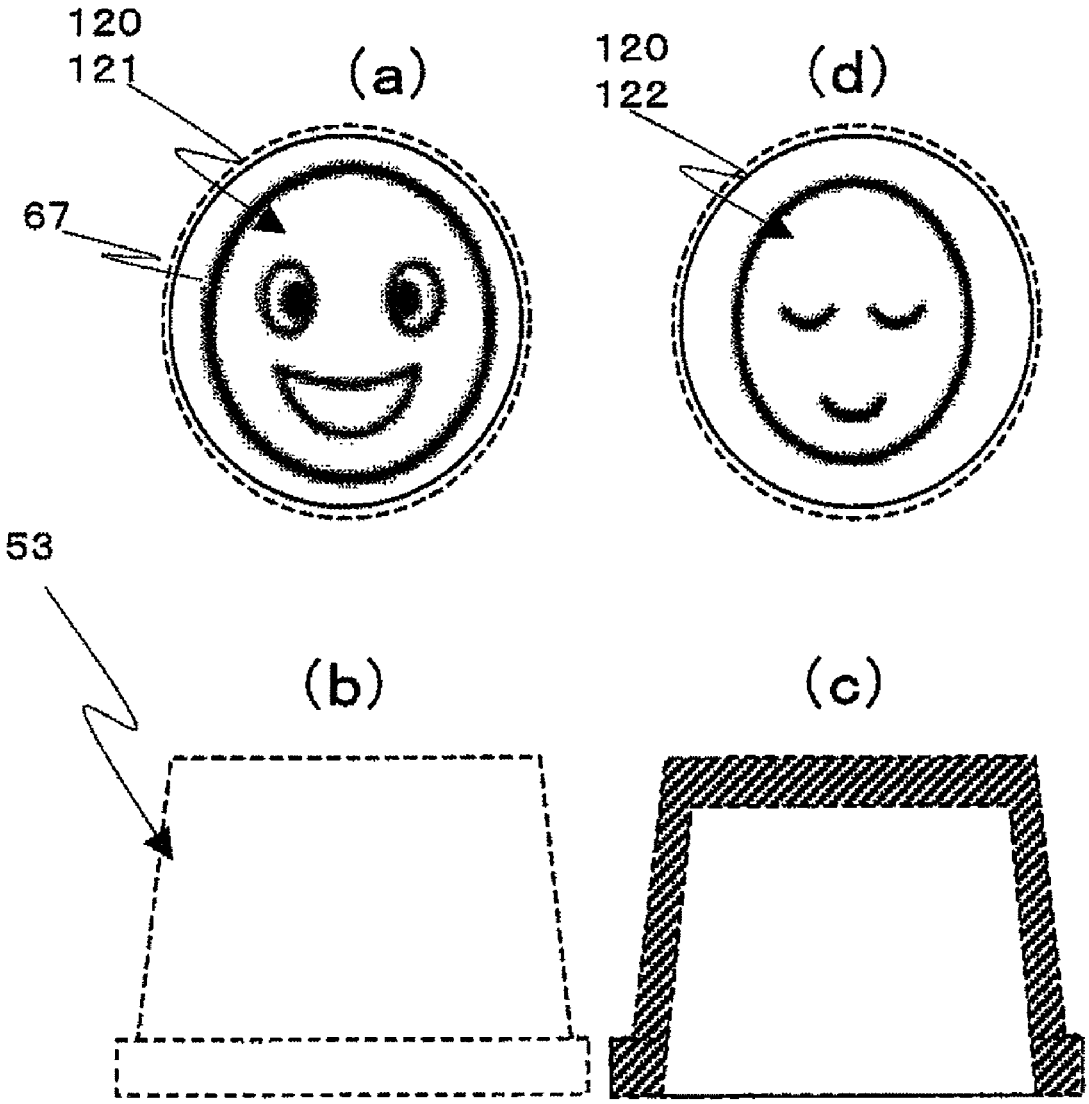
FIG. 26 is a perspective view showing an Open/close button having the shape of a frustum of a circular cone according to the second embodiment.

FIGS. 24 to 26 show an embodiment in which human pictograms are employed for the constituent buttons of the Open/close button 53, the button being formed in contours other than those described above. In FIG. 24 showing an appearance of pushing sections of the Open/close button having a circular letter display surface, (a) is a front view, (b) is a right-side view, (c) is a bottom view, (d) is a central cross-sectional view, and (e) to (i) are front views with other pictograms. The property of symmetry exists between the left-side view and the right-side view of (b) and between the top view and the bottom view (c). Hence, the left-side view and the top view are not shown. The rear view is almost equal in appearance with the front view of (a) excepting that the letter display surface 67 is not provided with any pattern. Respective views associated with the front views of (e) to (i) are similar to those associated with the front view of (a), and hence are not shown.

In the description of the Open/close button 53 shown in FIGS. 1 to 23 according to the first embodiment, the letter display surface 67 is constructed in a rectangular form. However, the present invention is not restricted by the embodiment, but is applicable to the Open/close button 53 including the letter display surface 67 having a circular form of, for example, a circle or an ellipse. Even when such a circular letter display surface 67 is used, by configuring the combination pictogram using two pictograms associated with mutually different state changes, for example, the combination pictogram 150 adopting the face pictograms of (a) and (i) or those of (e) and (f) or the combination pictogram 150 using the overall image pictograms 130 of (g) and (h), it is possible to obtain an advantage similar to the advantage of the first embodiment.

In FIGS. 25 and 26, the Open/close button 53 according to the embodiment is not restricted by the pushing section 62 having a thin outer form. The present invention is also applicable to, for example, the Open/close button 53 having the shape of a frustum of pyramid shown in FIG. 25 and the Open/close button 53 having the shape of a frustum of circular cone shown in FIG. 26.

FIG. 25 shows appearance of the Open/close button with the shape of a frustum of a pyramid. In FIG. 25, (a) is a top view, (b) is a front view, (c) is a central cross-sectional view, (d) is a top view with the personal pictogram 110 to be paired with (a), and (e) to (h) are front views with other pictograms. The property of symmetry exists between the left-side, right-side, and rear views and the front view of (b), and the bottom view will be easily imagined by use of the central cross-sectional view of (c). Hence, these views are not shown. Respective views associated with the front views of (d) to (h) are similar to those associated with the front view of (a), and hence are not shown.

Also for the Open/close button 53 shown in FIG. 25, there is employed the human pictogram 110 marked with the mutually associated states of, e.g., the views (e) and (f) or the combination pictogram 150 marked with the mutually associated operation pictograms, e.g., the views (g) and (h).

FIG. 26 shows appearance of the Open/close button having the shape of a frustum of a circular cone. In FIG. 26, (a) is a top view, (b) is a front view, (c) is a central cross-sectional view, and (d) is a top view with the human pictogram 110 to be paired with (a). The property of symmetry exists between the left-side, right-side, and rear views and the front view of (b) and the bottom view will be easily imagined by use of the central cross-sectional view of (c). Hence, these views are not shown.

Figure 27:
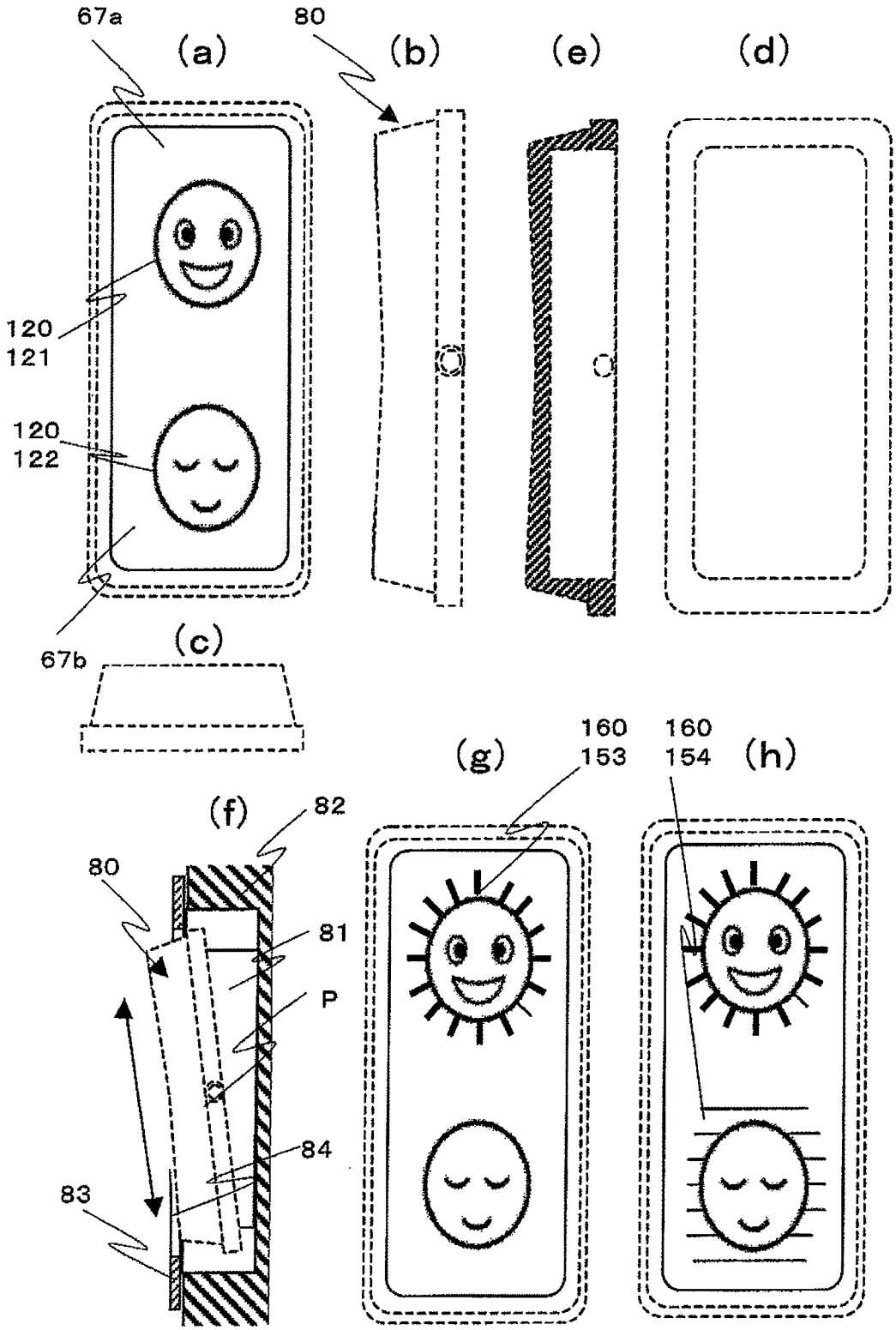
FIG. 27 is a perspective view showing a lamp switch according to the second embodiment.

In the embodiment shown in FIG. 27, there is also used a pair of face pictograms 120 provided with mutually different states, for example, the open-eye face pictogram 121 of (a) and the closed-eye face pictogram 122 of (b). It is also possible in the embodiment of FIG. 26 to use the paired pictograms shown in (e) to (h) of FIG. 24.

In the description of the embodiment shown in FIG. 27, the pictogram 100 is applied to the Open/close button 53 of the elevator apparatus. However, the present invention is not restricted by the embodiment. For example, FIG. 27 shows appearance of a lamp switch of seesaw type 80 capable of conducting the on and off operations by the use of one operation switch.

In FIG. 27 showing appearance of the lamp switch, (a) is a front view, (b) is a right-side view, (c) is a bottom view, (d) is a rear view, (e) is a central cross-sectional view, (f) is an installation state view, and (g) and (h) are front views of the switch with other pictograms. The property of symmetry exists between the left-side view and the right-side view of (b) and between the top view and the bottom view (c). Hence, the left-side view and the top view are not shown. Respective views associated with the views of (g) and (h) are similar to those associated with the front view of (a), and hence will not be shown.

When the lamp switch 80 is installed in a switch body 81 to swing about a rotation axis P, a letter display surface 67*a* shown in an upper section of the front view or a letter display surface 67*b* shown in a lower section of the front view projects from an opening 84 disposed in a switch plate 83 attached on a wall surface 82 to cover the front surface of the switch body 81. When the projection, e.g., the letter display surface 67*a* is pushed, the letter display surface 67*b* projects from the opening 84.

In the embodiment, the lamp is turned on when the letter display surface 67*a* is pushed. The lamp is turned off, when the letter display surface 67*b* is pushed. The on and off operations are assigned to mutually different states of "face with opened eyes and mouth" and "face with closed eyes and mouth". The open-eye face pictogram 121 is attached onto the letter display surface 67*a* to turn the lamp on, and the closed-eye face pictogram 122 is attached onto the letter display surface 67*b* to turn the lamp off, to thereby improve visibility and identifiability.

In the embodiment, for the operation pictogram 160, radial lines 153 may be drawn in the periphery of the open-eye face pictogram 121 to represent the on state of the lamp as shown in (g). The periphery of the closed-eye face pictogram 122 may be kept unchanged as in (g). However, a plurality of horizontal lines 154 expressing darkness as in (h) may be drawn in the periphery of the closed-eye face pictogram 122 in contrast with the radial lines 153, to further improve visibility and identifiability.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An operation apparatus, comprising an operation panel which has at least a pair of input switches including a first switch and a second switch, each respectively marked with pictograms, wherein the pictograms are prepared for respective input switches and each of the pictograms is made by combining a concretized human pictogram indicating mutually different state changes respectively associated with operation signals of the apparatus respectively assigned to the pair of input switches with an operation pictogram concretizing an operation target which operates in response to an operation signal, the first and second switches are arranged at positions adjacent to each other in the operation panel, and a difference between space area ratios of the first and second switches is equal to or greater than 15%, where a space area ratio of each switch is a ratio of a space area which is not occupied by the operation pictogram to an entire switch area.

2. An operation apparatus, comprising:

at least a pair of input switches to make an operation target of the apparatus conduct mutually different functional operations, wherein a pictogram in which a human pictogram indicating a state change associated with a respective functional operation is combined with an operation pictogram concretizing an operation mode of the operation target is disposed on each of the input switches, and a difference between space area ratios of the first and second switches is equal to or greater than 15%, where a space area ratio of each switch is a ratio of space area which is not occupied by the operation pictogram to an entire switch area.

3. An operation apparatus according to claim 2, wherein the human pictogram is a face pictogram.

4. An operation apparatus according to claim 3, wherein the human pictogram comprises at least a face contour and two eyes and a mouth in the face contour.

5. An operation apparatus according to claim 4, wherein:

the mutually different functional operations are an opening operation and a closing operation of the operation target;

an opening operation pictogram indicating a state in which the operation target opens and an open-eye face pictogram representing a state in which the eyes and the mouth are opened are disposed in combination with each other for an opening operation switch to cause execution of the opening operation; and a closing operation pictogram indicating a state in which the operation target closes and a closed-eye face pictogram representing a state in which the eyes and the mouth are closed are formed in combination with each other for a closing operation switch to cause execution of the closing operation.

6. An operation apparatus according to claim 5, wherein:

the opening operation switch comprises a space section in the switch area where the operation pictogram is not formed, the space section having a first ratio with respect to an area of the switch;

the closing operation switch comprises a space section in the switch area where the operation pictogram is not formed, the space section having a second ratio with respect to the area of the switch; and a ratio difference between the first and second ratios is equal to or more than 15%.

7. An apparatus comprising:

an operation panel having at least first and second input switches, wherein the first switch is marked with a first pictogram and the second switch is marked with a second pictogram, wherein the first pictogram is prepared by combining a first human pictogram indicating a first state with a first operation pictogram indicating a first operation;

wherein the second pictogram is prepared by combining a second human pictogram indicating a second state, different from the first state, with a second operation pictogram indicating a second operation;

wherein the first and second switches are arranged at positions adjacent to each other in the operation panel, and wherein a difference between space area ratios of the first and second switches is equal to or greater than 15%, where a space area ratio of the first switch is a ratio of a space area which is not occupied by the first operation pictogram to an entire switch area and a space area ratio of the second switch is a ratio of a space area which is not occupied by the second operation pictogram to an entire switch area.

8. An apparatus according to claim 7, wherein the first and second human pictograms are face pictograms.

9. An apparatus according to claim 7, wherein the first and second human pictograms each comprise at least a face contour and two eyes and a mouth in the face contour.

10. An apparatus according to claim 7, wherein:

the first and second operations are an opening operation and a closing operation for an operation target, respectively;

the first operation pictogram indicates a state in which the operation target opens and the first human pictogram is an open-eye face pictogram representing a state in which the eyes and the mouth are opened; and the second operation pictogram indicates a state in which the operation target closes and the second human pictogram is a closed-eye face pictogram representing a state in which the eyes and the mouth are closed.

11. An apparatus according to claim 10, wherein:

the first switch comprises a space section in the switch area where the first operation pictogram is not formed, the space section having a first ratio with respect to an area of the first switch;

the second switch comprises a space section in the switch area where the second operation pictogram is not formed, the space section having a second ratio with respect to the area of the second switch; and a ratio difference between the first and second ratios is equal to or more than 15%.

* * * * *